US007216950B2

(12) United States Patent
Eguchi et al.

(10) Patent No.: US 7,216,950 B2
(45) Date of Patent: May 15, 2007

(54) LIQUID-DISCHARGING APPARATUS, AND DENSITY ADJUSTING METHOD AND SYSTEM OF THE SAME

(75) Inventors: Takeo Eguchi, Kanagawa (JP); Kazuyasu Takenaka, Tokyo (JP); Takanori Takahashi, Kanagawa (JP); Ichiro Ujiie, Kanagawa (JP)

(73) Assignee: Sony Corporation, Tokyo (JP)

( * ) Notice: Subject to any disclaimer, the term of this patent is extended or adjusted under 35 U.S.C. 154(b) by 384 days.

(21) Appl. No.: 10/855,209

(22) Filed: May 27, 2004

(65) Prior Publication Data

US 2005/0001866 A1 Jan. 6, 2005

(30) Foreign Application Priority Data

Jun. 2, 2003 (JP) ..... 2003-156449

(51) Int. Cl.
*B41J 2/205* (2006.01)

(52) U.S. Cl. ..... 347/15; 358/1.9; 358/3.03

(58) Field of Classification Search ..... 347/15; 358/1.2, 1.9, 3.03
See application file for complete search history.

(56) References Cited

U.S. PATENT DOCUMENTS 5,225,849 A 7/1993 Suzuki et al.
5,384,859 A 1/1995 Bolza-Schunemann et al.
6,290,352 B1 9/2001 Marumoto et al.
6,443,550 B1 9/2002 Komiya et al.
2002/0063746 A1* 5/2002 Suzuki et al. ..... 347/19

FOREIGN PATENT DOCUMENTS

JP 58-022179 2/1983
JP 2002-240287 8/2002

* cited by examiner

*Primary Examiner*—Lamson Nguyen
(74) *Attorney, Agent, or Firm*—Robert J. Depke; Rockey, Depke, Lyons & Kitzinger LLC.

(57) ABSTRACT

A density-adjusting method of a liquid-discharging apparatus having a head including a plurality of juxtaposed liquid-discharging units having respective nozzles, forming dots by landing droplets discharged from the nozzles onto a droplet-landing object, and providing half tones by arranging a dot array is provided. A density-measuring pattern including all pixel trains lying in the main scanning direction with a constant density is formed, the density of the pattern is scanned so as to obtain density information and the relationship between the number and the density of droplets with respect to each pixel train. Upon receipt of a discharge command signal, based on the obtained data with respect to each pixel train, the density of the pixel train corresponding to the discharge command signal is adjusted by making the number of droplets to be actually discharged from the nozzles different from that of droplets discharged according to the discharge command signal.

21 Claims, 19 Drawing Sheets

FIG. 13

| NO. OF DROPLETS | 1 | 2 | 3 | 4 | 5 | 6 |
|---|---|---|---|---|---|---|
| (Y) | 73.0 | 108.9 | 136.2 | 157.5 | 173.6 | 185.2 |
| (M) | 76.3 | 116.9 | 145.1 | 168.5 | 188.0 | 202.7 |
| (C) | 88.1 | 134.0 | 167.4 | 193.5 | 213.9 | 230.6 |
| (K) | 89.8 | 139.6 | 174.9 | 203.1 | 224.6 | 240.3 |
| (Y) RELATIVE DENSITY | 1.000 | 1.493 | 1.867 | 2.159 | 2.379 | 2.539 |
| (M) RELATIVE DENSITY | 1.000 | 1.531 | 1.901 | 2.207 | 2.463 | 2.655 |
| (C) RELATIVE DENSITY | 1.000 | 1.521 | 1.901 | 2.197 | 2.428 | 2.619 |
| (K) RELATIVE DENSITY | 1.000 | 1.555 | 1.949 | 2.262 | 2.502 | 2.676 |
| AVERAGE RELATIVE DENSITY | 1.000 | 1.525 | 1.904 | 2.206 | 2.443 | 2.622 |
| $\gamma$ VALUE ON THE BASIS OF THE CASE OF ONE DROPLET | — | 0.619 | 0.586 | 0.571 | 0.555 | 0.538 |
| VALUE OF FUNCTION WITH $\gamma$ = 0.571 | 1.000 | 1.485 | 1.872 | 2.206 | 2.506 | 2.781 |

FIG. 18

| CALCULATION ORDER NO. | EXTERNAL INPUT | SIMPLE ROUND-OFF | | ERROR-CONSIDERED ROUND-OFF | | |
|---|---|---|---|---|---|---|
| | | OUTPUT | COMPUTATION ERROR | INTERNAL INPUT | OUTPUT | COMPUTATION ERROR |
| 0 | 1.200 | 1 | 0.200 | 1.200 | 1 | 0.200 |
| 1 | 1.161 | 1 | 0.161 | 1.361 | 1 | 0.361 |
| 2 | 1.122 | 1 | 0.122 | 1.482 | 1 | 0.482 |
| 3 | 1.082 | 1 | 0.082 | 1.565 | 2 | −0.435 |
| 4 | 1.044 | 1 | 0.044 | 0.608 | 1 | −0.392 |
| 5 | 1.005 | 1 | 0.005 | 0.613 | 1 | −0.387 |
| 6 | 0.967 | 1 | −0.033 | 0.580 | 1 | −0.420 |
| 7 | 0.929 | 1 | −0.071 | 0.508 | 1 | −0.492 |
| 8 | 0.891 | 1 | −0.109 | 0.399 | 0 | 0.399 |
| 9 | 0.854 | 1 | −0.146 | 1.253 | 1 | 0.253 |
| 10 | 0.817 | 1 | −0.183 | 1.071 | 1 | 0.071 |
| 11 | 0.781 | 1 | −0.219 | 0.852 | 1 | −0.148 |
| 12 | 0.746 | 1 | −0.254 | 0.598 | 1 | −0.402 |
| 13 | 0.711 | 1 | −0.289 | 0.309 | 0 | 0.309 |

LIQUID-DISCHARGING APPARATUS, AND DENSITY ADJUSTING METHOD AND SYSTEM OF THE SAME

The present application claims priority to Japanese Patent Application JP2003-156449, filed in the Japanese Patent Office Jun. 2, 2003; the entire contents of which is incorporated herein by reference.

BACKGROUND OF THE INVENTION

1. Field of the Invention

The present invention relates to a liquid-discharging apparatus including a head equipped with a plurality of juxtaposed liquid-discharging units having respective nozzles, forming dots by landing droplets discharged from the nozzles onto a droplet-landing object, and providing half tones by arranging a dot array, and also relates to a density adjusting method and a density adjusting system for adjusting the density of the dots. More particularly, the present invention is relates to a technique for adjusting density unevenness when the unevenness occurs due to a variation in discharging characteristics of the liquid-discharging units.

2. Description of the Related Art

An inkjet printer is known as one of conventional liquid-discharging apparatuses. The inkjet printer is equipped with a head including a large number of juxtaposed liquid-discharging units having respective nozzles, forms dots on a sheet of printing paper by discharging ink droplets from the nozzles, and forms an image by arranging arrays of the dots.

Also, a serial-type inkjet printer performs printing in the main scanning direction (in a direction perpendicular to a feeding direction of a sheet of printing paper by using a known method (see, for example, Japanese Examined Patent Application Publication No. 56-6033) for providing half tones by superimposing dots by reciprocating the head more than once, that is, by applying so-called overprinting. To be specific, according to the method, at every movement of the head in the main scanning directions the first recording is performed with a dot pitch greater than the diameter of a dot, and the second recording is performed by arranging a dot so as to cover the space between adjacent dots generated in the first recording.

With the above-mentioned overprinting for providing half tones, discharging characteristics of the liquid-discharging units are made more uniform, thereby making density unevenness indistinctive. Meanwhile, when the head has a plurality of liquid-discharging units juxtaposed side by side therein, a variation in discharging characteristics of the liquid-discharging units, for example, a variation in discharge amounts of ink droplets occur. Unfortunately, the head of the inkjet printer, for example, including thermal liquid-discharging units, can discharge only a constant amount of ink droplet from each nozzle during one discharging operation, except for a special head including a special discharging mechanism formed by utilizing the piezo technology. In other words, a discharge amount of an ink droplet during one discharging operation cannot be controlled.

As a countermeasure for solving the above disadvantage, overprinting is applied so a to make density unevenness substantially indistinctive even when a part of the liquid-discharging units have poor discharging characteristics, for example, discharging an insufficient amount or no amount of ink droplet due to clogging of the corresponding nozzles or the like.

Unfortunately, according to the above-mentioned overprinting method, problems such as density unevenness caused by a variation in discharging characteristics of the liquid-discharging units can not be completely solved.

Firstly, a problem arises from a certain limitation of an ink-absorbing amount of a sheet of printing paper. That is, when a dot is superimposed beyond the limitation of an ink-absorbing amount of a sheet of printing paper, the dot is unlikely dried, and also, to make matters worse, ink of the dot spreads over the adjacent dots and generates color mixture with that of the adjacent dots, thereby leading to a failure in achieving an expected density gradation characteristic.

Secondly, when high image quality, for example equivalent to that of a photographic image is required, existence of even a small part of the liquid-discharging units of the head which do not normally discharge ink droplets makes a streak or the like distinctive. For example, when a color other than black is printed in a pupil area in the case of printing an image such as a facial portrait, or when a color other than red is printed in an apple or flower area in the case of expressing such an object, the foregoing color becomes distinctive even when its printed area is tiny.

In order to solve such density unevenness, a thermal sublimination printer or the like normally having a line head structure has an example countermeasure incorporated therein as described below.

FIG. 21 illustrates a general method for correcting density unevenness by image processing. A density measuring-pattern (test pattern) providing a uniform and constant density is first printed so as to measure a state of density unevenness with respect to each color across the full sheet of paper. Then, the printed result with respect to each color is scanned by an image-scanning apparatus. Since the scanned data includes density information and unevenness information, the average density and coefficients of unevenness over the all pixels are computed. In addition, a data table obtained by multiplying all positions corresponding to the pixels of an input image by the reciprocals of coefficients of unevenness corresponding to the positions (that is, obtained by computation with an inverse function) is produced and stored.

When an image is inputted, multiplication process is performed on the basis of the data table before image processing so as to produce a corrected image file, and a printing operation is performed on the basis of information of the corrected image file, whereby density unevenness peculiar to the head is canceled.

Meanwhile, this method is presently used for printers other than an inkjet printer, and it will be appreciated that it is also applicable to an inkjet printer.

Unfortunately, the foregoing known method for correcting density unevenness is needed to process an input image, and, especially when an input image including a large amount of data is required to be processed, a longer period of time for processing the input image is needed before printing, thereby resulting in a reduced printing speed.

Improvement in the printing speed incurs an increase in hardware, memory, and the like, and hence causes a larger size of the printer.

SUMMARY OF THE INVENTION

Accordingly, an object of the present invention is to adjust density unevenness caused by a variation in discharging characteristics of a plurality of liquid-discharging units without incurring a reduction in a printing speed and the like, also without incurring an increase in a hardware, a memory, and the like, when the density of a pixel train formed by a liquid-discharging apparatus including a head equipped with the plurality of juxtaposed liquid-discharging units is adjusted.

The above-described problems are solved by the present invention as will be described below.

A density-adjusting method according to the present invention, of a liquid-discharging apparatus which includes a head including a plurality of juxtaposed liquid-discharging units having respective nozzles, which forms dots by landing droplets discharged from the nozzles onto a droplet-landing object, and which provides half tones by arranging a dot array includes the steps of: (i) obtaining density information, and the relationship between the number and the density of discharged droplets with respect to each pixel train (a) by providing a droplet-discharging command signal to the liquid-discharging apparatus so as to provide a uniform and constant density to all pixel trains lying in the main scanning direction (b) by forming a density-measuring pattern on the droplet-landing object by discharging a predetermined number of droplets from each liquid-discharging unit, and (c) by scanning the density of the density-measuring pattern; and (ii) controlling the head, upon receipt of a droplet-discharging command signal, on the basis of the previously obtained density information and the relationship between the number and the density of discharged droplets with respect to each pixel train, so as to adjust the density of the pixel train corresponding to the discharge command signal by making the number of droplets to be actually discharged from the liquid-discharging units different from the number of droplets discharged in accordance with the discharge command signal.

According to the density-adjusting method according to the present invention, a droplet-discharging command signal is provided to the liquid-discharging apparatus so as to provide a uniform and constant density to all pixel trains lying in the main scanning direction, and a density-measuring pattern is formed by the liquid-discharging apparatus. The density of the density-measuring pattern is scanned so as to obtain density information with respect to each pixel train (for example, a difference between the density of each pixel train and the average density of all pixel train, obtained by scanning the densities of all pixel trains), and the obtained density information is stored in a memory installed in the liquid-discharging apparatus or a memory of a computer or the like submitting a droplet-discharging command signal to the liquid-discharging apparatus.

When a discharge command signal is actually inputted in the liquid-discharging apparatus, on the basis of the density information stored in the memory of the computer or the liquid-discharging apparatus submitting the discharge command signal, the liquid-discharging apparatus is controlled so as to adjust the density of the pixel train corresponding to the discharge command signal by making the number of droplets to be actually discharged from the liquid-discharging units different from the number of droplets discharged in accordance with the discharge command signal. For example, when the density of a pixel train to be adjusted is lower than the average density by 10%, the liquid-discharging apparatus is controlled so as to increase the number of droplets by 10%.

BRIEF DESCRIPTION OF THE DRAWINGS

FIG. 13 is a table illustrating average values, relative densities of measured densities for colors of yellow (Y), magenta (M), cyan (C), and black (K), and the average relative density for all colors.

FIG. 18 is a table illustrating differences in computed results between a round-off method according to the present embodiment (according to a method of considering an error into the subsequent input) and a simple round-off method;

DESCRIPTION OF THE PREFERRED EMBODIMENTS

Preferred embodiments of the present invention will be described with reference to the attached drawings. In the following descriptions an inkjet printer (hereinafter, simply referred to as a printer) is used as a liquid-discharging apparatus according to the present invention by way of example.

In the description, a term "ink droplet" means a very small amount (for example, a few picolillters) of ink (liquid) discharged from a nozzle 18 of a liquid-discharging unit, which will be described later.

A term "dot" means one form of an ink droplet landed on a recording medium such as a sheet of printing paper.

Also, a term "pixel" is a minimum unit of an image, and, in addition, a term "pixel area" means an area in which a pixel is formed.

Thus, when a predetermined number (zero, one, or a plurality of pieces) of droplets are landed in a single pixel area, a pixel (1-step gradation) with no pixel, a pixel (2-step gradation) with a single dot, or a pixel (3 or more-step gradation) with a plurality of dots is respectively formed. That is, zero, one, or a plurality of pieces of dots corresponds to a single pixel area, and an image is formed by arranging a large number of these pixels on a recording medium.

Meanwhile, all dots corresponding to a pixel do not always lie in its pixel area, but a part of the dots sometimes lie out of the pixel area.

A term "main scanning direction" means a transporting direction of a sheet of printing paper in a line-type printer equipped with a line head. In the meantime, with respect to a serial-type printer, terms "main scanning direction" and "sub scanning direction" are respectively defined as a moving direction of a head (a width direction of a sheet of printing paper) and a transporting direction of a sheet of printing paper, that is, a direction perpendicular to the main scanning direction.

A term "pixel train" means a group of pixels lining in the main scanning direction. Accordingly, in a line-type printer, a group of pixels lining in the transporting direction of a sheet of printing paper form a pixel train. In the meantime, in a serial-type printer, a group of pixels lining in the moving direction of a head form a pixel train.

A term "pixel line" means a line perpendicular to a pixel train, for example, in a line-type printer, a line along which liquid-discharging units (or nozzles) are juxtaposed side by side.

Structure of Head

Figure 1:
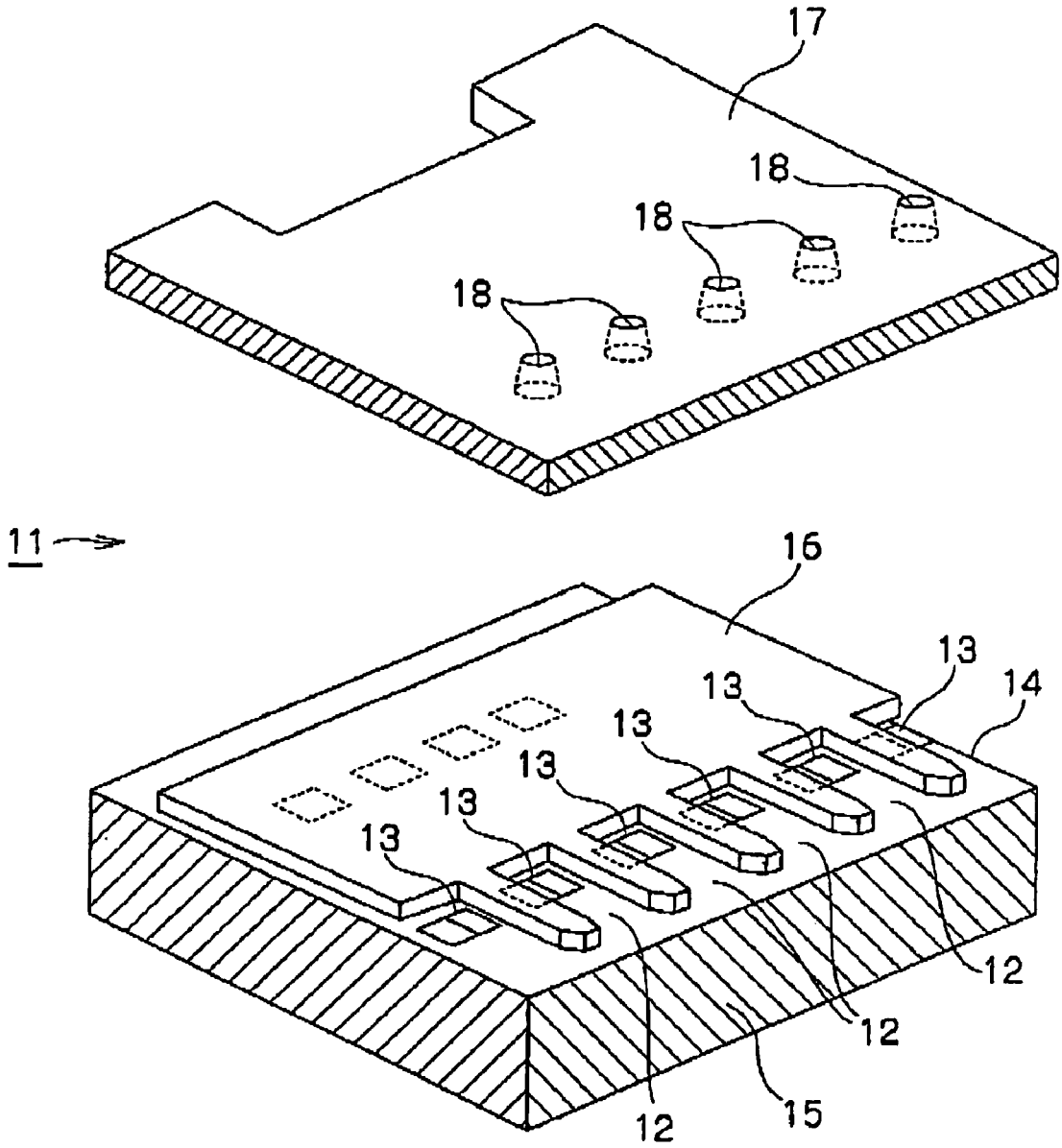
FIG. 1 is an exploded perspective view of a head of an inkjet printer including a liquid-discharging apparatus according to the present invention.

FIG. 1 is an exploded perspective view of a head 11 of the printer. A nozzle sheet 17 shown in FIG. 1 in an exploded manner is bonded to the upper surface of a barrier layer 16.

The head 11 includes a substrate member 14 including a semiconductor substrate 15 composed of silicon or the like and heating resistors 13 deposited on one of the surfaces of the semiconductor substrate 15. The heating resistors 13 are electrically connected to an external circuit, having a conducting portion (not shown) formed on the semiconductor substrate 15, interposed therebetween.

The barrier layer 16 is composed of, for example, photosensitive cyclized rubber resist or exposure-curable dry film resist and is laminated on the entire surface on which the heating resistors 13 of the semiconductor substrate 15 are formed, and then an unnecessary part thereof is removed by lithography.

The nozzle sheet 17 having the plurality of nozzles 18 formed therein is composed of nickel by electroforming, for example, and is bonded to the upper surface of the barrier layer 16 such that the positions of the nozzles 18 agree with those of the corresponding heating resistors 13, that is, such that the nozzles 18 are placed so as to face the corresponding heating resistors 13.

The head 11 also includes ink chambers 12, each defined by the substrate member 14, the barrier layer 16, and the nozzle sheet 17 so as to surround the corresponding heating resistor 13. That is, in the figure, the substrate member 14, the barrier layer 16, and the nozzle sheet 17 serve as the bottom wall, the side wall, and the top wall of each ink chamber 12, respectively. With this structure, each ink chamber 12 has an opening area extending toward a right front direction in FIG. 1 so as to be in communication with the corresponding ink-flow channel (not shown).

A single of the head 11 generally includes the ink chambers 12 of an order of 100 units and the heating resistors 13 disposed in the corresponding ink chambers 12. In response to a command from a control unit of the printer, the head 11 uniquely selects each of the heating resistors 13 and discharges ink in the ink chamber 12 corresponding to the selected heating resistor 13 from the nozzle 18 facing the ink chamber 12.

More particularly, the ink chambers 12 are filled with ink from an ink tank (not shown) connected to the head 11. When a pulse current is fed to the selected heating resistor 13 for a short.period of time, for example, 1 to 3 μsec, the heating resistor 13 is quickly heated. As a result, a gaseous-phase ink bubble is generated in ink in the ink chamber 12, lying in contact with the heating resistor 13, and a certain volume of ink is pushed away due to expansion of the ink bubble (that is, ink is brought to boiling). With this arrangement, ink having substantially the same volume as that of the ink lying in contact with the nozzle 18 and pushed away as mentioned above is discharged from the corresponding nozzle 18 as an ink droplet, landed on a sheet of printing paper, and forms a dot (pixel).

In this specification, a component made up by one of the ink chambers 12, the heating resistor 13 disposed in the ink chamber 12, and the nozzle 18 disposed above the ink chamber 12 is referred to as a liquid-discharging unit. That is, the head 11 has a plurality of liquid-discharging units therein which are juxtaposed side by side.

Figure 2:
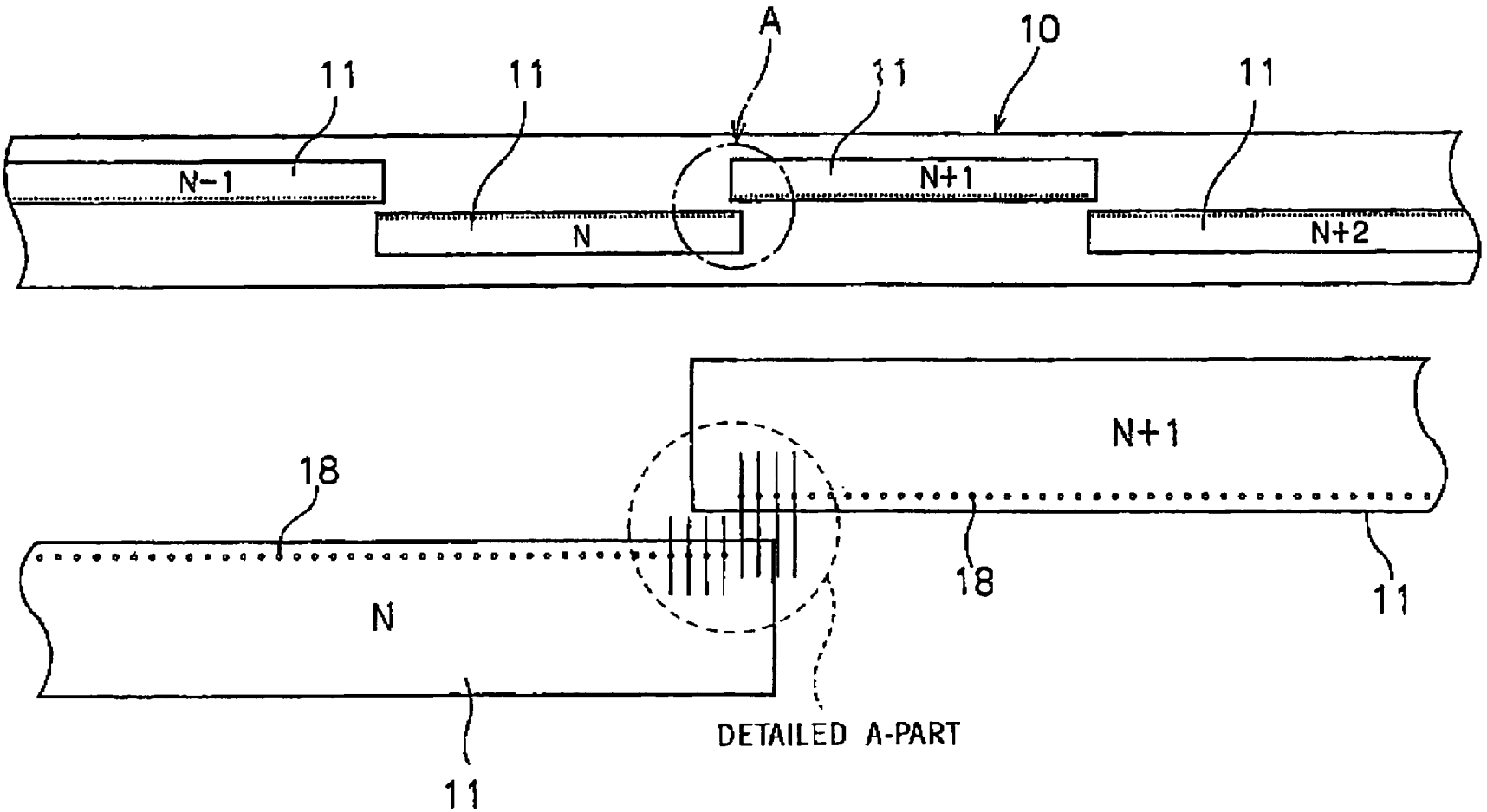
FIG. 2 is a plan view of a line head according to an embodiment of the present invention.

Also, in the present embodiment, a plurality of the heads 11 is juxtaposed side by side in the width direction so as to form a line head 10. FIG. 2 is a plan view of the line head 10 according to the embodiment, illustrating four of the heads 11; (N−1)-th, N-th, (N+1)-th, and (N+2)-th heads 11. When the line head 10 is formed, a plurality of components (head chips) is juxtaposed side by side, each formed by the head 11 from which the nozzle sheet 17 is removed in FIG. 1.

Then, a single sheet of the nozzle sheet 17 having the nozzles 18 formed therein so as to correspond to the respective liquid-discharging units of all head chips is bonded to the upper surfaces of these head chips. Meanwhile, all heads 11 are disposed such that a pitch between the nozzles 18 lying at the ends of the mutually adjacent heads 11, that is, such that, as shown in a detailed A-part of FIG. 2, a space between the nozzles 18 respectively lying at the right and left ends of the N-th and (N+1)-th heads 11 is the same as that between adjacent nozzles 18 of each head 11.

Discharge-direction-changing Means

The head 11 includes discharge-direction-changing means. The discharge-direction-changing means according to the present embodiment changes the discharge direction of an ink droplet discharged from each nozzle 18 into a plurality of directions within a direction along which the nozzles 18 (liquid-discharging units) are juxtaposed side by side and has a structure as described below.

Figure 3:
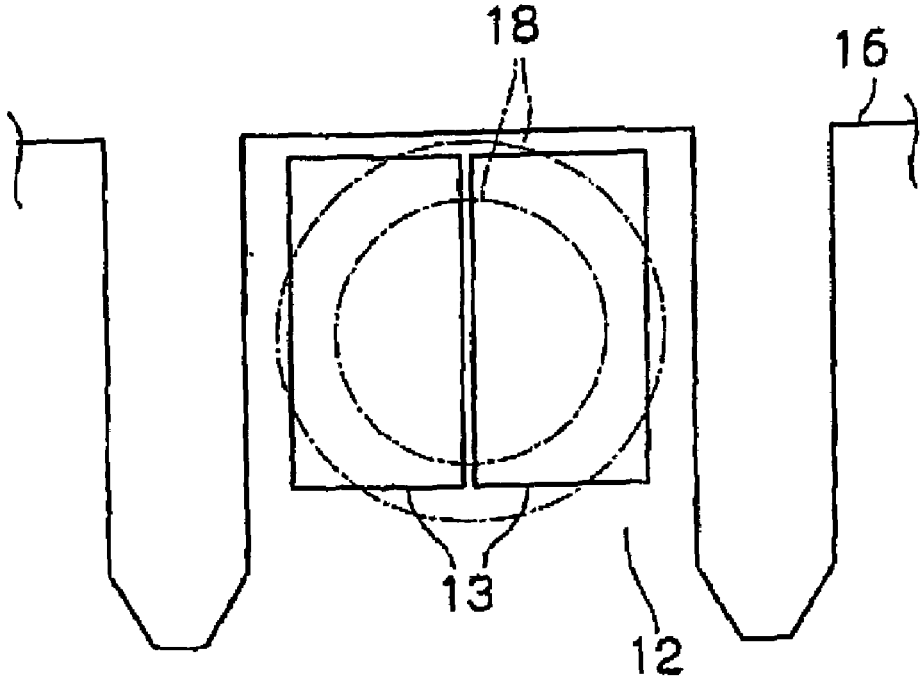
FIG. 3 provides a plan view and a sectional view, illustrating the detailed arrangement of a heating resistor of the head.
Figure 3:
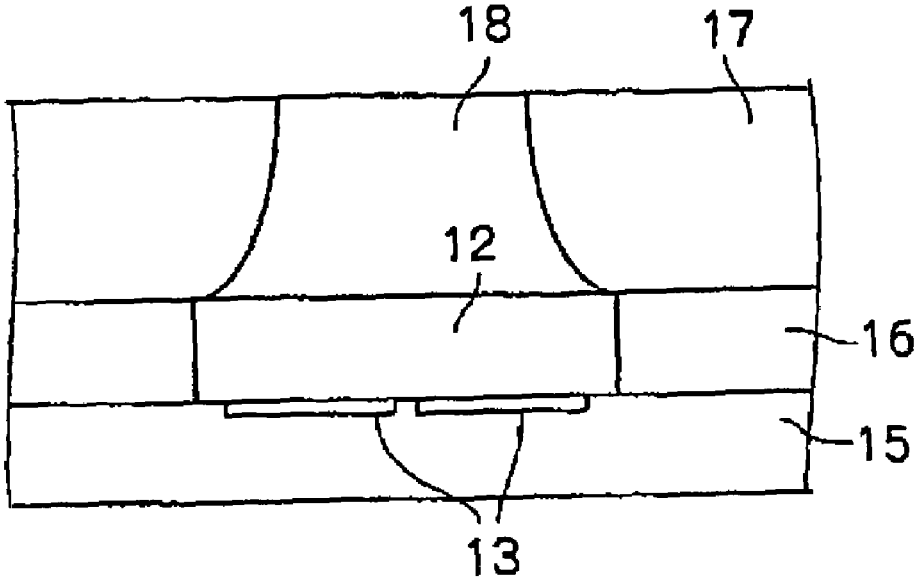

FIG. 3 provides a plan view and a sectional view, illustrating the detailed arrangement of the heating resistor 13 of the head 11. In the plan view of FIG. 3, the position of the nozzle 18 is indicated by a dotted-chain line.

As shown in FIG. 3, the head 11 according to the present embodiment has two-way-divided parts of the heating resistor 13 juxtaposed side by side in a single of the ink chamber 12. Also, the divided parts of the heating resistor 13 are juxtaposed side by side in the direction (the horizontal direction in FIG. 3) along which the nozzles 18 are juxtaposed side by side.

When the two-way-divided parts of the heating resistor 13 are disposed in a single of the ink chamber 12 as described above, by arranging such that a time (bubble generation time) needed for each divided part of the heating resistor 13 to attain a temperature at which ink is brought to boiling is identical with respect to all divided parts, ink on the divided parts of the heating resistor 13 is simultaneously heated to boiling, whereby an ink droplet is discharged along the central axis direction of the nozzle 18.

In the meantime, when the bubble generation times of the divided parts of the heating resistor 13 are different from each other, ink on the divided parts of the heating resistor 13 is not simultaneously heated. In this case, an ink droplet is discharged along a direction deflected from the central axis direction of the nozzle 18. Hence, the ink droplet can be landed at a position deflected from a landing position at which the ink droplet would be landed when discharged without deflection.

Figure 4A:
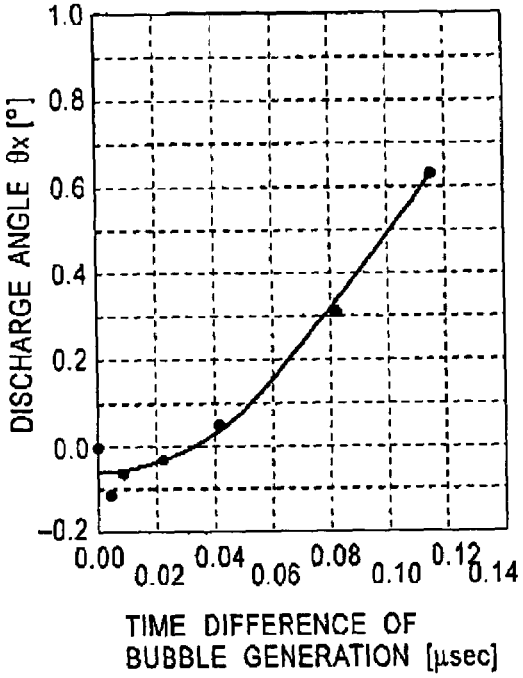
FIGS. 4A to 4C are graphs, each illustrating the relationship between time difference in bubble generations of ink and discharge angle due to divided parts of a heating resistor when the heating resistor is divided into a plurality of parts.
Figure 4B:
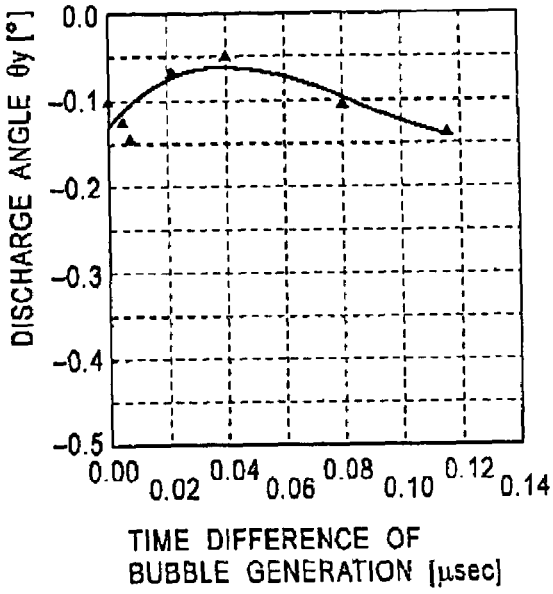

FIGS. 4A and 4B are graphs obtained by computer simulation, illustrating the relationship between time difference in bubble generations and discharge angle due to the divided parts of the heating resistor 13 when the heating resistor 13 is divided into a plurality of parts as set forth in the present embodiment. In these graphs, the X-direction (direction shown by the vertical axis $\theta_x$ in FIG. 4A, not meaning the horizontal direction of these graphs) is the direction along which the nozzles 18 (the heating resistors 13) are juxtaposed side by side are juxtaposed side by side, and the Y-direction (direction shown by the vertical axis $\theta_y$ in FIG. 4B, not meaning the vertical direction of these graphs) is a direction (the transporting direction of a sheet of printing paper) perpendicular to the X-direction. Also, angles of the X-direction and Y-direction without deflection are both set at 0°, and each of the X-direction and Y-direction indicates a deflection from 0°.

Figure 4C:
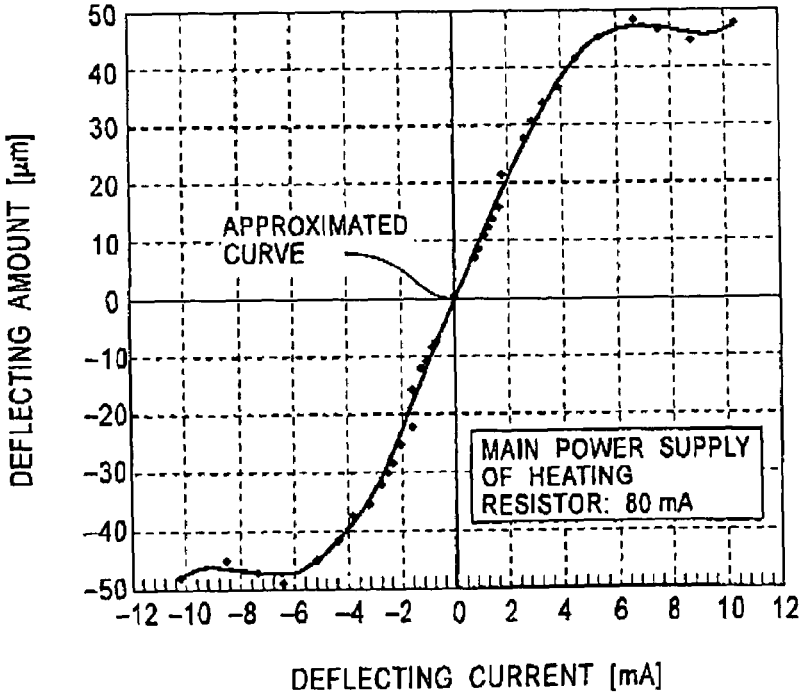

Also, FIG. 4C is a graph of measured data when a difference in generation times of bubbles of ink on the two-way-divided parts of the heating resistors 13 is defined as a reflecting current given by half a difference in currents fed to the two-way-divided parts of the heating resistors 13 and is represented by the horizontal axis, and a discharge angle of an ink droplet (in the X-direction) is defined as a deflecting amount of the ink droplet at its landing position (measured when the distance between the nozzle 18 and the landing position is set at about 2 mm) and is represented by the vertical axis. In the case of FIG. 4C, an ink droplet is discharged in a deflecting manner by setting a current of the main power supply of the heating resistor 13 at 80 mA, and the defelecting current is superimposed on one of the two-way-divided parts of the heating resistor 13.

When the two parts of the heating resistors 13, divided in the direction along which the nozzles 18 are juxtaposed, generates bubbles at different times from each other, an ink droplet is not discharged at a right angle on a sheet of printing paper, and a discharge angle $\theta_x$ of the ink droplet in the direction along which the nozzles 18 are juxtaposed becomes greater as the time difference becomes greater.

Hence, the above-mentioned feature is utilized in the present embodiment. That is, by disposing the two-way-divided parts of the heating resistors 13 and, by feeding different amounts of currents to these divided parts of the heating resistor 13 from each other, the liquid-discharging apparatus is controlled so as to cause ink on the divided parts of the heating resistor 13 to generate an ink droplet at different times from each other and accordingly to deflect the discharge direction of the ink droplet.

For example, when the two-way-divided parts of the heating resistors 13 do not have a common resistance as each other due to a manufacturing error or the like, bubble generation times of the divided parts of the heating resistor 13 are different from each other, and an ink droplet is not discharged at a right angle on a sheet of printing paper, a landing position of the ink droplet is deflected from its originally intended position. However, when bubble generation times of ink on both divided parts of the heating resistor 13 are controlled so as to be identical by feeding different amounts of current to the two-way-divided parts of the heating resistors 13 from each other, the ink droplet can be discharged at a right angle.

Figure 5:
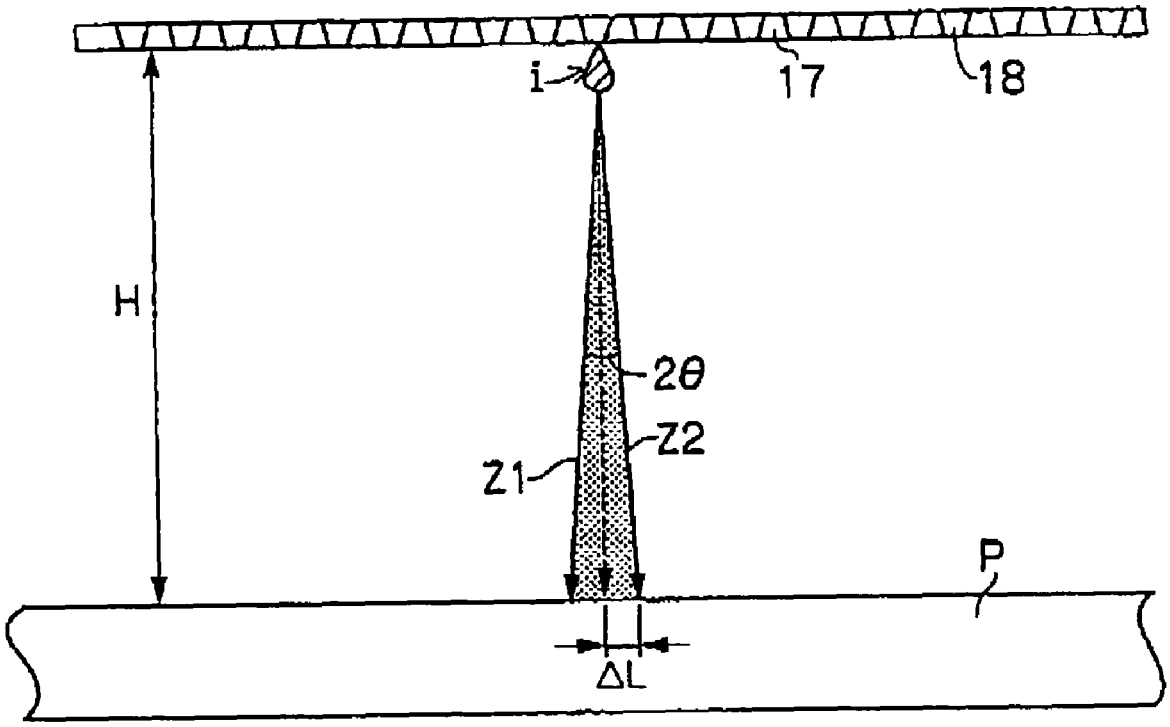
FIG. 5 illustrates deflection of the discharge direction of an ink droplet.

FIG. 5 illustrates deflection of the discharge direction of an ink droplet. As shown in FIG. 5, when an ink droplet i is discharged orthogonal to the discharging surface of the corresponding nozzle 18, the ink droplet i is discharged without deflection as shown by the dotted arrow indicated in FIG. 5. In the meantime, when the discharge direction of the ink droplet i is deflected such that its discharge angle is deflected by θ from the vertical direction (that is, deflected along either Z1 or Z2 direction shown in FIG. 5), the landing position of the ink droplet i is deflected by ΔL given by the following expression:

$$\Delta L = H \times \tan\theta.$$

As described above, when the discharge direction of the ink droplet i is deflected by an angle θ from the vertical direction, the landing position of the ink droplet is deflected by ΔL.

Meanwhile, in a typical inkjet printer, since the distance H between the top of the nozzle 18 and a sheet of printing paper P is about 1 to 2 mm, it is assumed that the distance H is held at an almost constant value of about 2 mm. The reason for holding the distance H at an almost constant value is such that, when a variance in the distance H causes the landing position of the ink droplet i to vary. That is, when an ink droplet i is discharged from the nozzle 18 orthogonal to the plane of the sheet of printing paper P, even when the distance H varies somewhat, the landing position of the ink droplet i does not vary. In contrast to this, when an ink droplet i is discharged in a deflecting manner as described above, the landing position of the ink droplet i varies in accordance with a variance in the distance H.

Discharge-Direction-Controlling Means

By using the head 11 having the above-described discharge-direction-changing means incorporated therein, in the present embodiment, a discharge control of an ink droplet is performed by discharge-direction-controlling means as described below.

The discharge-direction-controlling means controls at least two nearby liquid-discharging units so as to discharge ink droplets into respectively different directions and to land the discharged droplets on a single pixel train so as to form a single pixel train or in a single pixel area so as to form a single pixel.

Meanwhile, in the present invention, as a first form of the discharge-direction-controlling means, it is arranged such that an ink droplet from each nozzle 18 is variably discharged into one of an even number $2^J$ (J: a positive integer) of directions in accordance with a control signal made up by J bits, and also the interval between the remotest landing positions of two ink droplets of those discharged into the $2^J$ directions is $(2^J-1)$ times the interval between the adjacent nozzles 18. With this arrangement, when an ink droplet is discharged from the nozzle 18, one of the $2^7$ directions is selected.

Alternatively, as a second form of the means for controlling a discharge direction, it is arranged such that an ink droplet from the nozzle 18 is variably discharged into one of an odd number $(2^J+1)$ of directions in accordance with a control signal made up by (J bits+1), and also the interval between the remotest landing positions of two ink droplets of those discharged into the $(2^J+1)$ directions is $2^J$ times the interval between the adjacent nozzles 18. With this arrangement, when an ink droplet is discharged from the nozzle 18, one of the $(2^J+1)$ directions is selected.

For example, in the first form of the controlling means, it is assumed that a control signal made up by J (=2) bits is used, possible discharge directions of an ink droplet is an even number of $2^J$ (=4). Also the interval between the remotest landing positions of two ink droplets of those discharged into $2^j$ directions is $\{3=(2^J-1)\}$ times the interval between the adjacent the nozzles 18. Also, in the second form of the above controlling means, it is assumed that a control signal made up by {(J=2) bits +1} is used, possible discharge directions of an ink droplet is an odd number of $\{5=(2^{J+1})\}$. Also, the interval between the remotest landing positions of two ink droplets of those discharged into $(2^J+1)$ directions is $2^J$ (=4) times the interval between the adjacent the nozzles 18.

Figure 6:
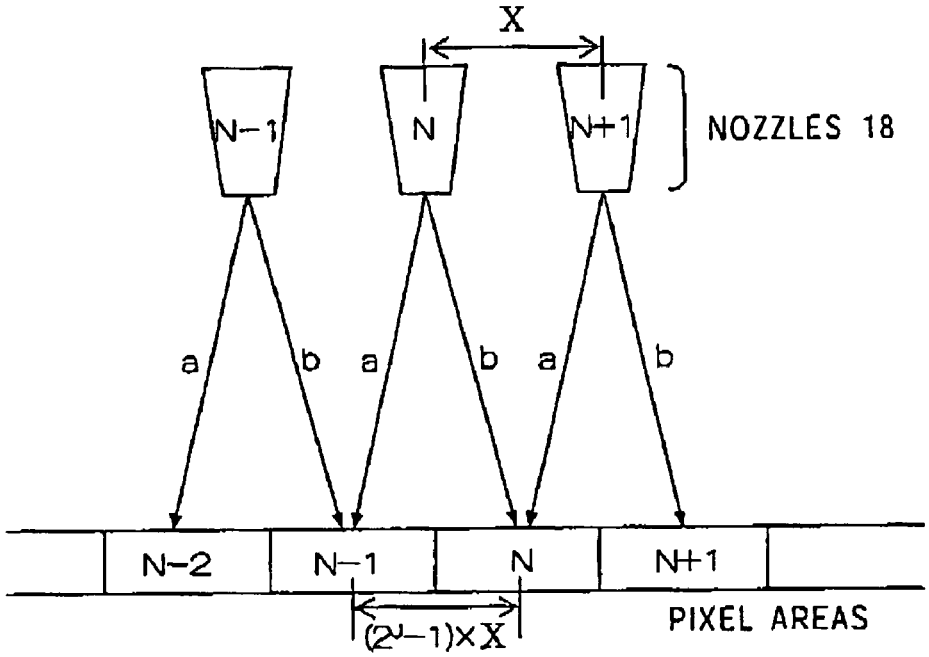
FIG. 6 illustrates an example in which ink droplets from adjacent liquid-discharging units are landed in a single pixel area, and discharge directions of each ink droplet are set at an even number.

FIG. 6 more specifically illustrates discharge directions of an ink droplet when a control signal made up by J (=1) bit is used in the first form of the controlling means. In the first form of the controlling means, discharge directions of an ink droplet can be set so as to right and left symmetrical directions within the direction along which the nozzles 18 are juxtaposed side by side.

With this arrangement, when the interval between the remotest landing positions of two $(=2^J)$ ink droplets is set so as to be $\{1=(2^J-1)\}$ times the interval between the adjacent nozzles 18, that is, equal to the interval between the adjacent nozzles 18, ink droplets from the adjacent nozzles 18 can be landed in a single pixel area as shown in FIG. 6. In other words, when the interval between the adjacent nozzles 18 is defined as X as shown in FIG. 6, the distance between the adjacent pixel areas is given by $(2^J-1)\times X$ (in the example shown in FIG. 1, given by $\{X=(2^J-1)\times X)\}$. Meanwhile, in this case, a landing position of an ink droplet lies between the adjacent nozzles 18.

Figure 7:
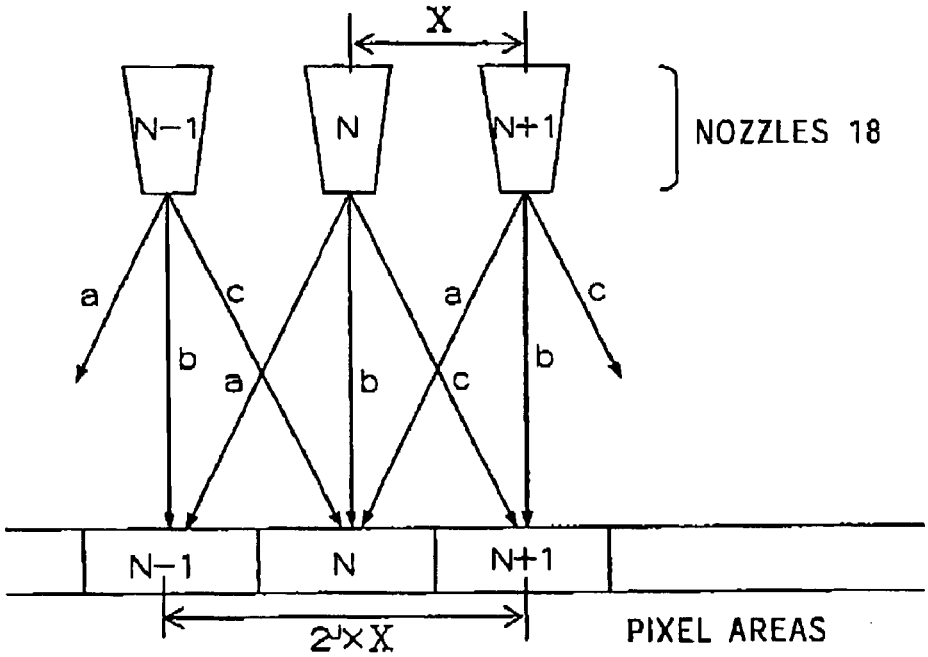
FIG. 7 illustrates an example in which discharge directions of an ink droplet from each liquid-discharging unit are set at an odd number by discharging the ink droplet into right and left symmetrical directions in a defelecting manner and directly below the liquid-discharging unit.

Also, FIG. 7 more specifically illustrates discharge directions of an ink droplet when a control signal made up by (J (=1) bit+1 is used in the second form of the foregoing controlling means. In the second form of the above controlling means, discharge directions of an ink droplet can be set at an odd number. More particularly, while, in the first form of the foregoing control means, discharge directions of an ink droplet from each nozzle 18 can be set at an even number of right and left symmetrical directions within the direction along which the nozzles 18 are juxtaposed side by side, in the second form of the controlling means, the discharge directions of an ink droplet can be set at an odd number, by using a part of the control signal made up by +1, the ink droplet can be also discharged directly below the nozzle 18. Accordingly, the discharge directions can be also set at an odd number of right and left symmetrical directions (represented by reference characters "a" and "c" shown in FIG. 7) and a direction directly below the nozzle 18 (represented by a reference character "b" in FIG. 7).

In FIG. 7, the control signal is made up by {J (=1) bit+1}, and the discharge directions are an odd number of 3 $\{=(2^J+1)\}$. Also, of three discharge directions $\{=(2^J+1)\}$, the interval between the remotest landing positions of two ink droplets is set so as to be twice $(=2^J)$ the interval (shown by X in FIG. 7) between the adjacent the nozzles 18 (in FIG. 7, set so as to be $2^J\times X$), and one of three $(=2^J+1)$ discharge directions is selected when an ink droplet is discharged.

With this arrangement, as shown in FIG. 7, ink droplets from a nozzle N can be landed not only in a pixel area N lying directly below the nozzle N but also in pixel areas (N−1) and (N+1) adjacent to the pixel area N.

Also, the landing positions of ink droplets are opposed to the nozzles 18.

As described above, at least two nearby liquid-discharging units (nozzles 18) can land ink droplets in at least one single pixel area depending on the way of using a control signal. Especially, when a pitch of the liquid-discharging units in the juxtaposing direction is defined as X as shown in FIGS. 6 and 7, each liquid-discharging unit can land ink droplets at positions lying along the direction along which the liquid-discharging units are juxtaposed and given by the following expression with respect to its vertical center axis:

$$\pm(\tfrac{1}{2}\times X)\times P \text{ (P: a positive integer).}$$

Figure 8:
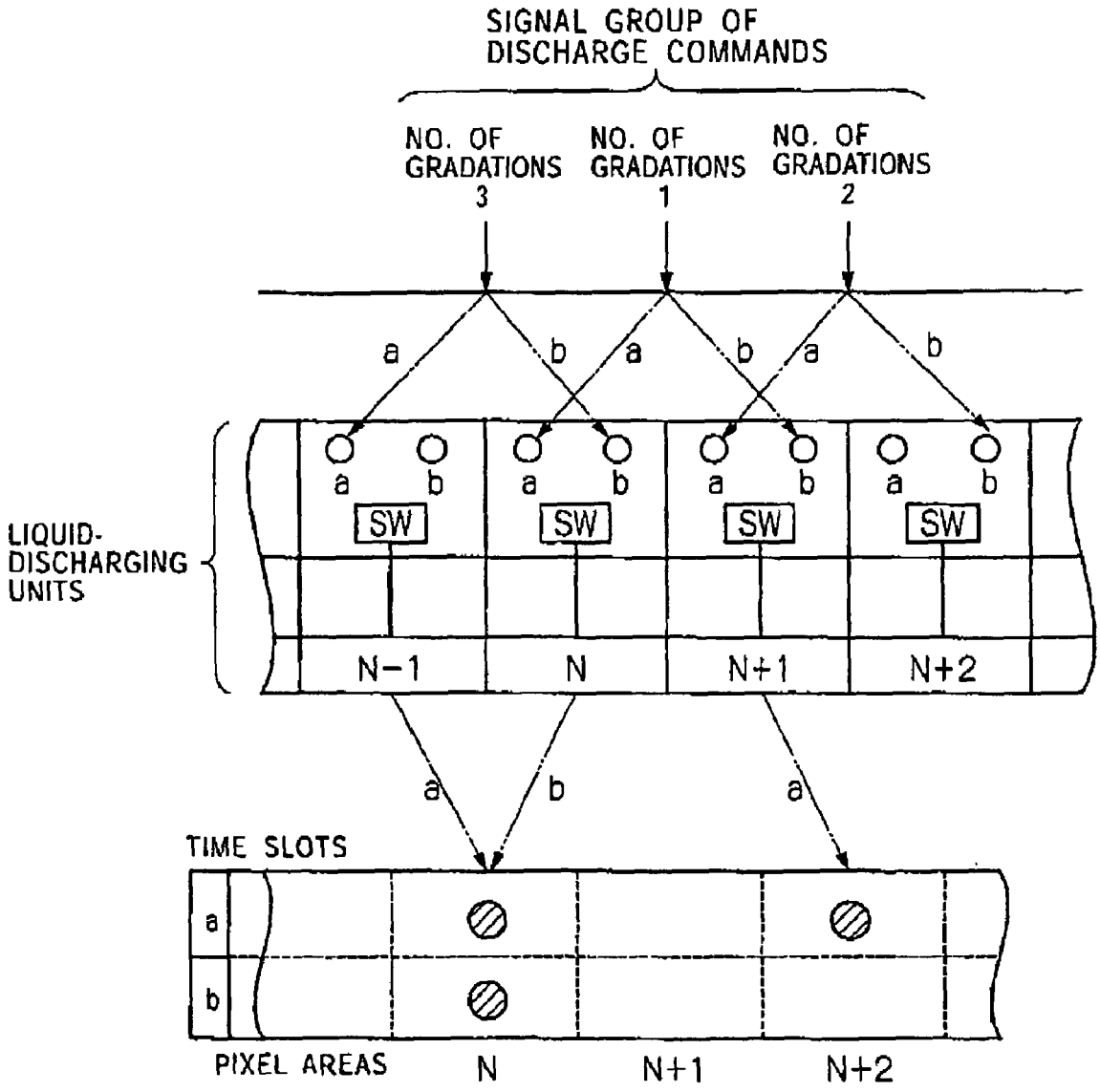
FIG. 8 illustrates a process of forming each pixel on a sheet of printing paper by the liquid-discharging units, each discharging droplets into two directions (having an even number of discharge directions) in accordance with discharge command signals.

FIG. 8 illustrates a pixel forming method (with two-direction discharge) when a control signal made up by J (=1) bit is used in the first form of the controlling means (allowing ink droplets to be discharged into an even number of directions).

That is, FIG. 8 illustrates a process of forming each pixel on a sheet of printing paper by the liquid-discharging units, each discharging droplets into two directions (having an even number of discharge directions) in accordance with discharge command signals sent in parallel to the head 11. The discharge command signals correspond to image signals.

In FIG. 8, the number of gradations of discharge command signals of pixels N, (N+1), and (N+2) are respectively set at 3, 1, and 2.

A discharge command signal of each pixel is sent to predetermined liquid-discharging units at an interval of "a" or "b", and also, each liquid-discharging unit discharges an ink droplet at the above-mentioned interval "a" or "b". The intervals "a" and "b" correspond to time slots "a" and "b" respectively. In the present embodiment, a plurality of dots is formed in a single pixel area, for example, during an interval of "a" plus "b" in accordance with the number of gradations of the corresponding discharge command signal. For example, during the interval "a", discharge command signals of the pixels N and (N+2) are respectively sent to liquid-discharging units (N−1) and (N+1).

Then, the liquid-discharging unit (N−1) discharges an ink droplet in the "a" direction in a deflecting manner so as to be landed at the position of the pixel N on a sheet of printing paper. Also, the liquid-discharging unit (N+1) discharges an ink droplet in the "a" direction in a deflecting manner so as to be landed at the position of the pixel (N+2) on the sheet of printing paper.

With this arrangement, an ink droplet corresponding to the number of gradations: 2 is landed at the position of each pixel in the time slot "a". Since the number of gradations of the discharge command signal of the pixel (N+2) is 2, the pixel (N+2) is thus formed. The same process is repeated for the time slot "b".

As a result, the pixel N is formed by two dots corresponding to the number of gradations; 3.

With this dot-forming method, since ink droplets discharged from a single liquid-discharging unit are not continuously (twice or more) landed in a pixel area corresponding to a single pixel number so as to form a pixel regardless of the number of gradations, a variation in dots due to a variation in discharging characteristics of the liquid-discharging units can be reduced. Also, for example, even when a discharge amount of an ink droplet from any one of the liquid-discharging units is insufficient, a variation in areas shared by dots in the corresponding pixels can be reduced.

Figure 9:
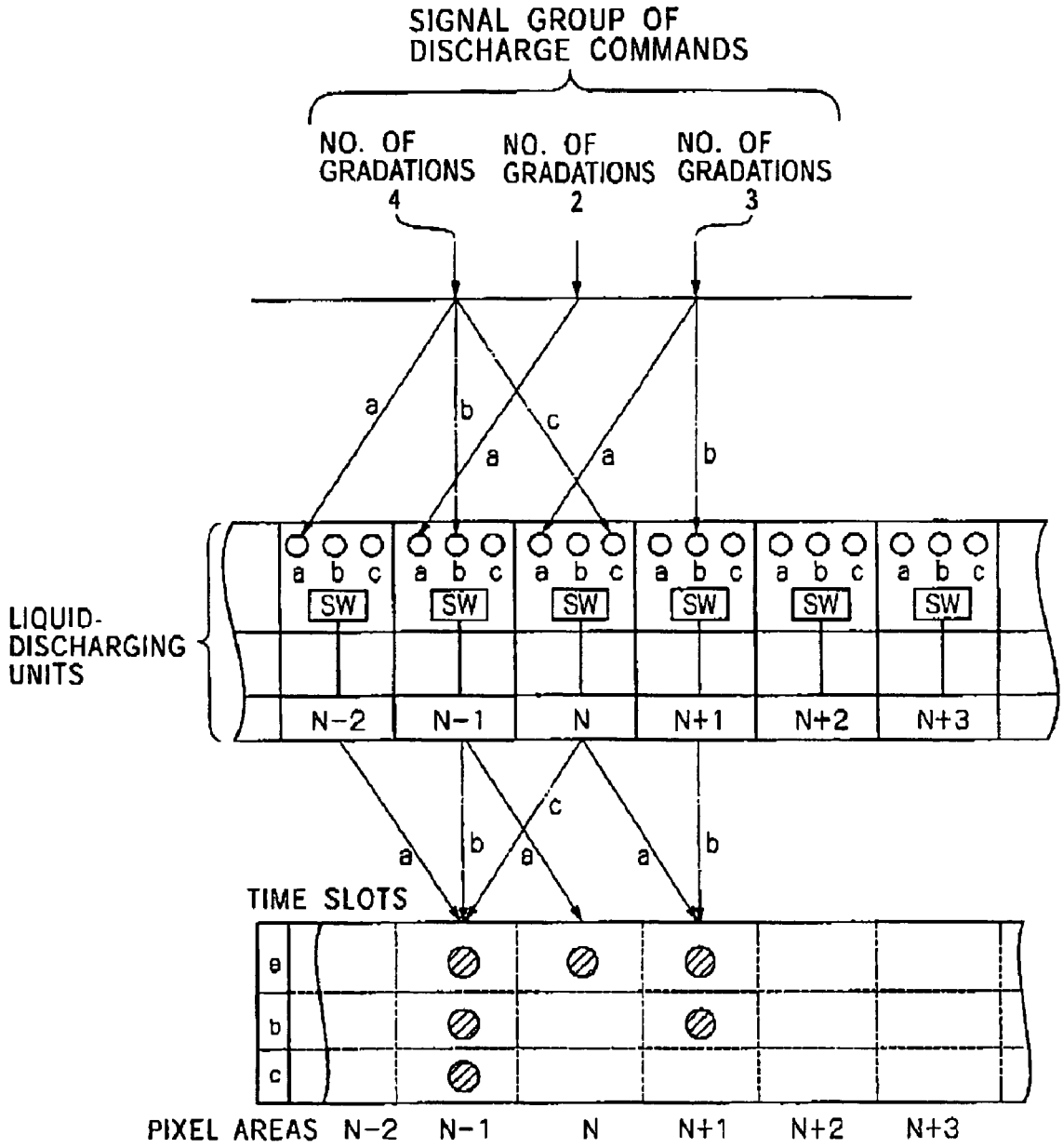
FIG. 9 illustrates a process of forming each pixel on a sheet of printing paper by the liquid-discharging units, each discharging droplets into three directions (having an odd number of discharge directions) in accordance with discharge command signals.

Also, FIG. 9 illustrates another pixel forming method (with three-direction discharge) when a control signal made up by {J (=1) bit+1} is used in the second form of the controlling means (allowing ink droplets to be discharged into an odd number of directions).

Although a pixel-forming process shown in FIG. 9 is not described here because of being the same as that illustrated in FIG. 8, also in the second form of the controlling means, in the same fashion as in the first form of the controlling means, with the discharge-direction-controlling means, at least two nearby liquid-discharging units can be controlled so as to discharge ink droplets into respectively different directions and to land the discharged droplets on a single pixel train so as to form a pixel train or in a single pixel area so as to form a pixel.

Subsequently, a density-adjusting method according to an embodiment of the present invention will be described.

Figure 10:
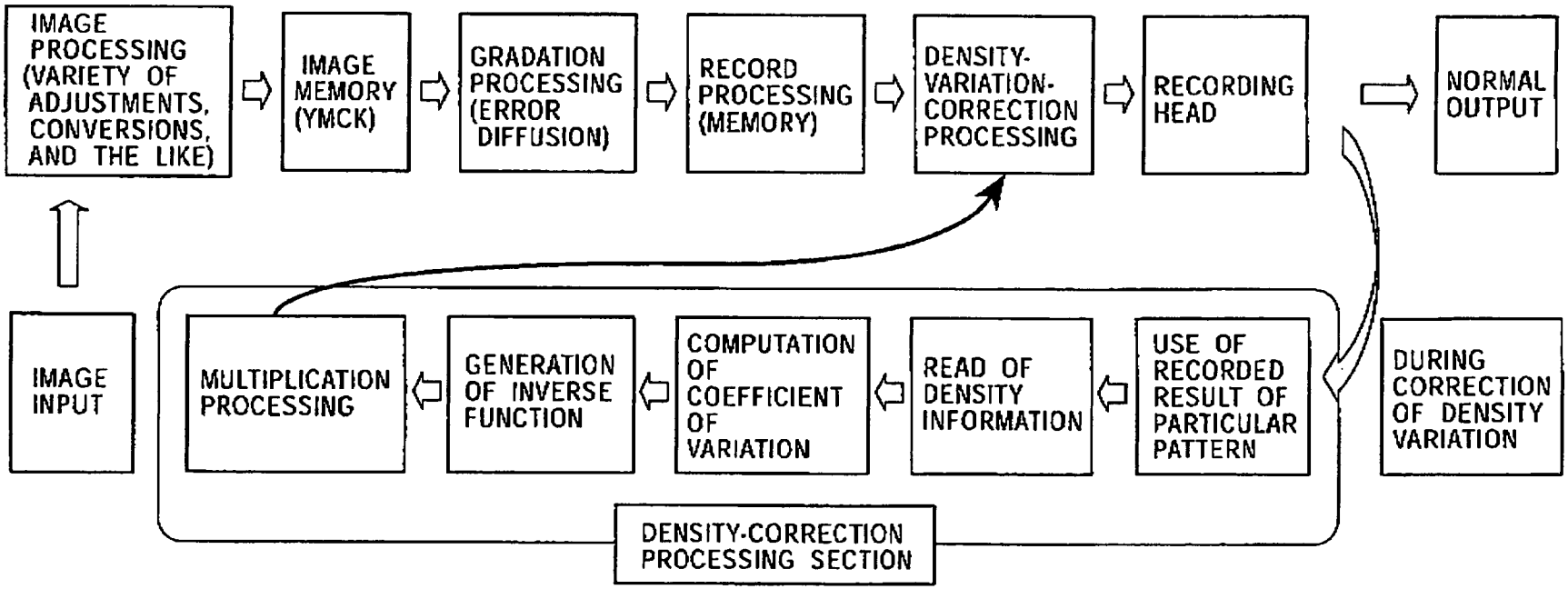
FIG. 10 illustrates a general density-adjusting method according to an embodiment of the present invention.
Figure 21:
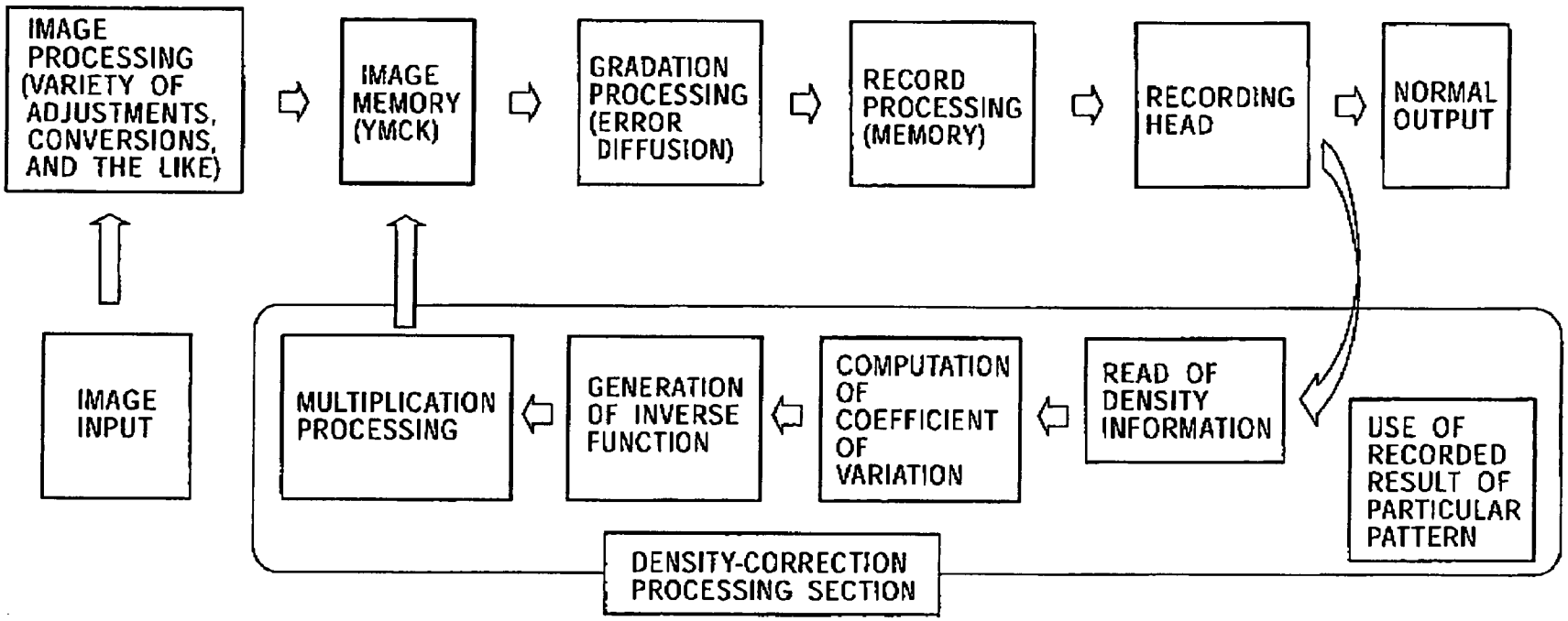
FIG. 21 illustrates a general method for correcting density unevenness by image processing.

FIG. 10 illustrates a general density-adjusting method according to the embodiment and corresponding to that of a known art shown in FIG. 21.

With the density-adjusting method according to the embodiment, upon receipt of a discharge command signal of ink droplets, on the basis of density information and relationship between the number and the density of ink droplets, both previously obtained with respect to each pixel train, the liquid-discharging apparatus is controlled so as to adjust the density of the pixel train corresponding to the discharge command signal by making the number of ink droplets to be actually discharged from the liquid-discharging units different from the number of ink droplets discharged in accordance with the discharge command signal.

In other words, density adjustment is performed with respect to each pixel train not with respect to each liquid-discharging unit. In particular, when a single pixel train is formed by using a plurality of liquid-discharging units as described in the present embodiment, by performing density adjustment with respect to each pixel train, discharging characteristics peculiar to the individual liquid-discharging units are not needed to be especially taken into consideration. Also, by performing density adjustment with respect to each pixel train, the density adjustment can be performed by common signal processing regardless of whether an ink droplet is discharged in a deflecting manner or not.

The density-adjusting method has a greatly different point from a known art in that density adjustment processing is performed after performing image processing and gradation processing. In other words, when an image is inputted, image processing (adjusting brightness and contrast, correcting a γ characteristic, and so forth) and gradation processing including error diffusion are performed on the assumption that discharging characteristics of all liquid-discharging units are uniform, and density adjustment processing is performed in a step after the image processing and as close as possible to a step of discharging an ink droplet.

That is, upon receipt of input image information, gradation processing including image processing and error diffusion is performed on the assumption that the density of dot.arrays formed by all liquid-discharging units is constant, and the liquid-discharging apparatus is controlled so as to adjust the density of a pixel train corresponding to a discharge command signal converted after the gradation processing by discharging a different number of ink droplets from the liquid-discharging units, from the number of droplets discharged in accordance with the discharge command signal.

A specific example of the density-adjusting method according to the present embodiment will be described. In a printer as used in the present embodiment, since an accumulated amount of discharged ink-droplets is in proportion to the number of ink droplets, and the density of ink droplets is expressed by the γ-th power of the number of the ink droplets, a recording signal, in particular, the number of discharged ink-droplets in this embodiment, and the obtained density have a functional relationship with each other.

When a pixel train is formed by discharging ink droplets from any one of the liquid-discharging units, its printing characteristic is uniform along the pixel train. In contrast to this, when a pixel train is formed by the remaining liquid-discharging units, its printing characteristic is not identical to that of the pixel train formed by said one of the liquid-discharging units due to a variation in discharging characteristics of the remaining liquid-discharging units.

In view of the above-mentioned disagreement, although the number of discharged ink-droplets is constant for the common discharge command signal, a discharge amount of each ink droplet differs from one liquid-discharging unit to another.

Figure 11:
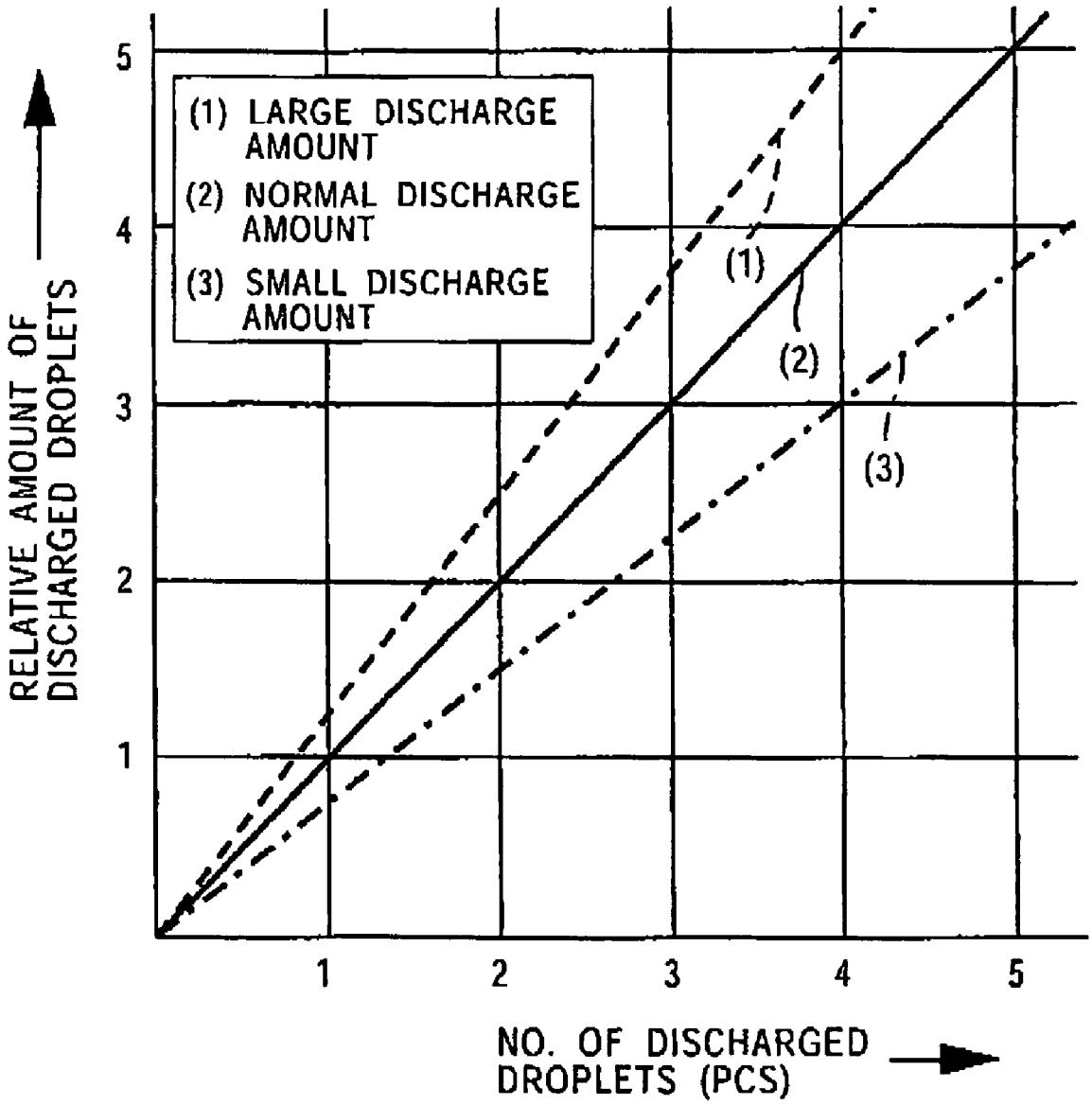
FIG. 11 is a graph illustrating the relationship between the number of discharged droplets and a relative amount of discharged droplets.

FIG. 11 is a graph illustrating the relationship between the number of discharged droplets and a relative amount of discharged droplets. In the figure, cases of discharging a normal amount, a large amount, and a small amount of a single droplet are illustrated by straight lines (2), (1), and (3), respectively.

That is, although discharging characteristics of the liquid-discharging units vary from one liquid-discharging unit to another as shown by the lines (1) to (3), and this variation cannot be physically adjusted by the respective liquid-discharging units, the number of discharged droplets can be arbitrarily selected. Hence, even when a discharge amount of each droplet varies from one liquid-discharging unit to another, the total amount of discharged droplets can be brought into agreement with an intended one.

When it is assumed that the characteristics illustrated by (1) to (3) in FIG. 11 are respectively given by the following expressions:

$$M1=A1\times N,$$

$$M2=A2\times N, \text{ and}$$

$$M3=A3\times N,$$

where An (n=1, 2, 3) is a proportionality constant, M1, M2, M3 is a total amount of discharged ink-droplets discharged N times from each liquid-discharging unit, numbers N1 to N3 of discharged ink-droplets satisfy the following expression are can be found:

$$M=A1\times N1=A2\times N2=A3\times N3.$$

Hence, even when the characteristic of each liquid-discharging unit, that is, a discharge amount of an ink droplet discharged once from the liquid-discharging unit, is different from one liquid-discharging unit to another, the total amounts of ink droplets discharged from the liquid-discharging units can be made identical.

When the density and the number of discharged ink-droplets are respectively defined as I and N, and the coefficient γ is used, the density is given by the following expression:

$$I=An\times N^{\gamma}.$$

Figure 12:
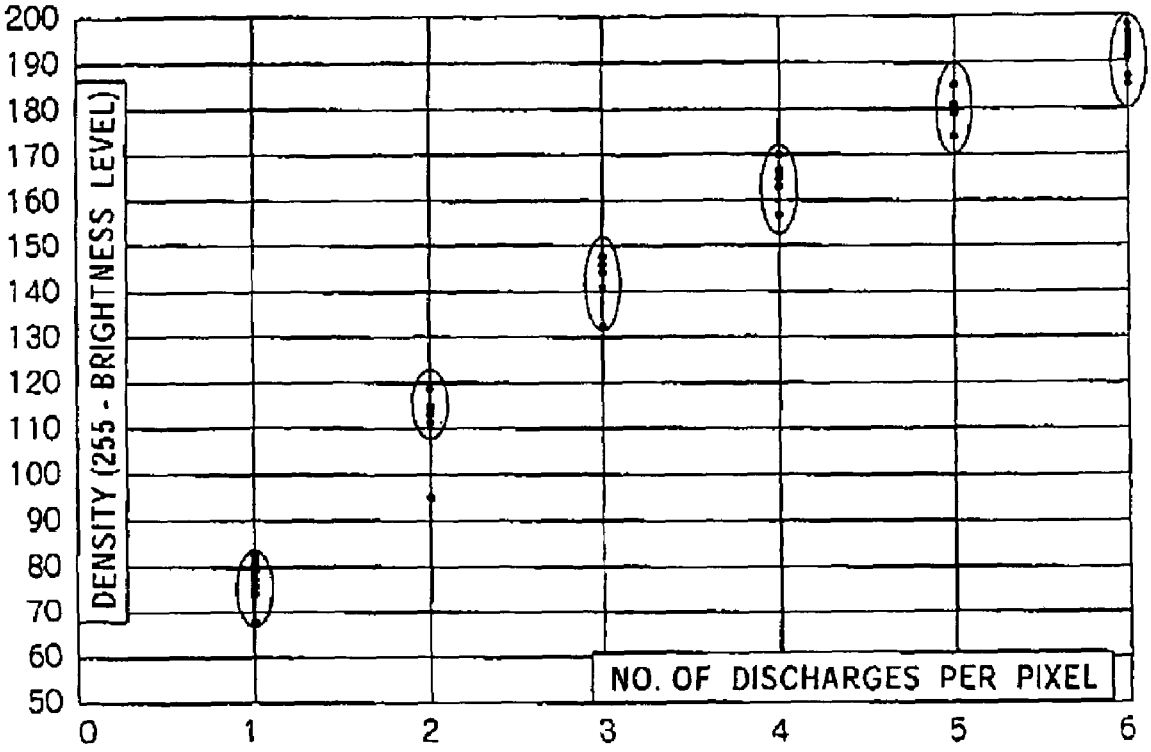
FIG. 12 is a graph illustrating a part of density-distribution characteristics, measured at every number of discharge operations per pixel when droplets are discharged from each liquid-discharging unit with four colors of ink.

On the basis of the above-described concept, ink droplets are discharged from each liquid-discharging unit with four colors of ink, and a density-distribution characteristic of the droplets at every number of discharged droplets is measured. FIG. 12 illustrates a part of the measured results. In FIG. 12, yellow (Y) ink is used.

The vertical and horizontal axes of FIG. 12 respectively indicate a value obtained such that output (brightness) levels tare subtracted from an 8 bit output (255) levels and the number (0 to 6) of discharged ink-droplets per each pixel. Also, each ellipse shown in FIG. 12 indicates a density-distribution area.

Figure 14:
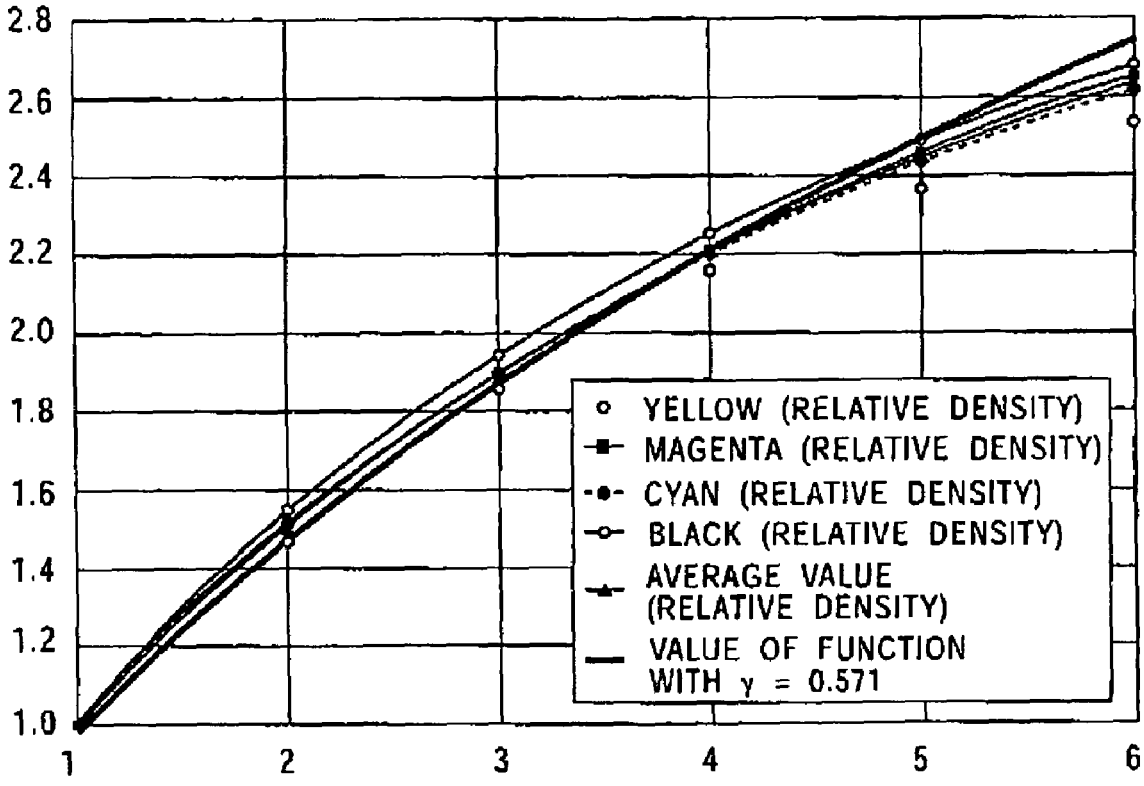
FIG. 14 is a graph of the results shown in FIG. 13.

FIG. 13 is a table illustrating average values, relative densities of measured densities with respect to colors of yellow (Y), magenta (M), cyan (C), and black (K), the average relative density for all colors, γ values (=natural logarithms of the number of droplets divided by natural logarithms of average relative densities), and values of function with γ=0.571 (a value when the number droplets is 4). Also, FIG. 14 is a graph of the results shown in FIG. 13. As shown in FIG. 14, a γ-characteristic with respect to each color is approximately given by a function with γ=0.571, that is, given by the following expression:

$$I=An\times N^{0.571}.$$

Since the above equation includes variables of An and N, when a density variation occurs, the variation is nullified by changing N (the number of discharged ink-droplets).

For example, if An varies to An', the variation of An can be absorbed by changing the number of discharged droplets from N to N' so as to satisfy the following expression:

$$An\times N^{0.571}=An'\times N'^{0.571}, \text{ or}$$

$$N'=N\times(An/An')^{1.75}.$$

As described above, when the number N' of discharged droplets given by the above expression is used, the densities of An and An' can be made equal to each other.

Also, in the present embodiment, a density-measuring pattern (test pattern) formed in accordance with a discharge command signal providing a constant density to all pixel trains is printed by the liquid-discharging apparatus, in a state in which density adjustment and the like are not performed at all. The density-measuring pattern is printed with respect to each color.

Then, each printed result is scanned by an image-scanning apparatus such as an image scanner so as to detect the density of each pixel train.

Although the printed result can be scanned by a digital camera or the like other than an image scanner, disposed independently from the printer, it can be scanned by an image-scanning apparatus disposed in the printer, for example, next to the line head 10. With this structure, when the printed result is inserted into the printer again, for example, after it is printed, it can be scanned by the image-scanning apparatus while being transported by a drive and transport system.

Alternatively, an image-scanning apparatus may be disposed downstream of the line head 10 (so as to scan a printed image after a sheet of printing paper is printed. With this structure, since the density of the printed image is measured by the image-scanning apparatus while the sheet of printing paper is being printed, when the density-measuring pattern is printed, the printed image thereof is scanned at the same time.

Figure 15:
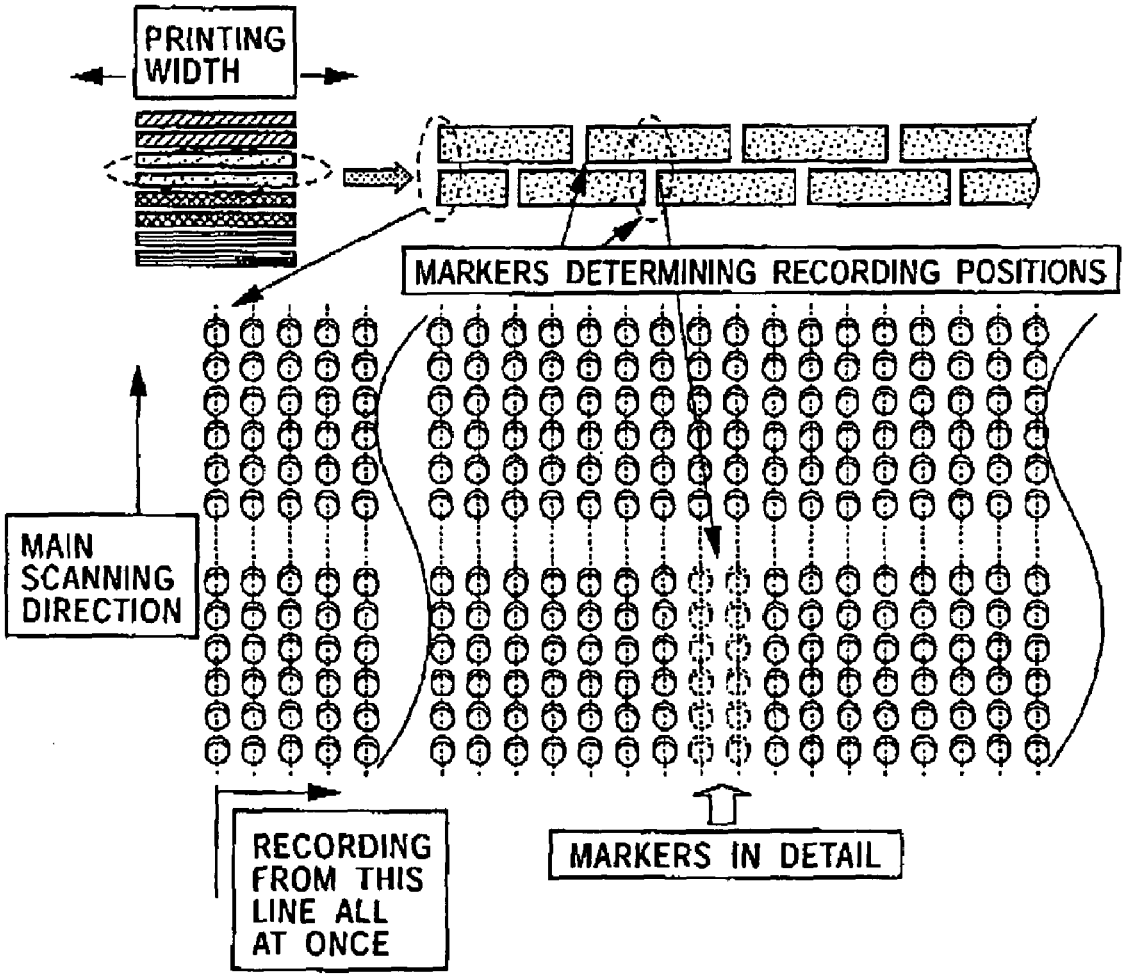
FIG. 15 illustrates a density-measuring pattern.

FIG. 15 illustrates an example density-measuring pattern.

The density-measuring pattern is formed by a plurality of pairs of belt-shaped patterns, each formed by dots arranged so as to extend in the direction along which the liquid-discharging units are juxtaposed side by side, and each pair formed with respect to each color, having a predetermined space therebetween. Meanwhile, the reason for forming a pair of patterns is as below: since markers (pixel trains having no dots therein) are inserted at predetermined positions of each pattern for determining how-manieth a pixel train in question is disposed with respect to these markers, the densities of pixel trains lying in parts of each pattern where the markers are inserted cannot be measured. To solve this problem, a pair of patterns are recorded. In other words, in a pixel train including makers, the density of the pixel train is scanned from one of the pair of patterns including no makers. In a pixel train including no markers, the density of any one of the patters may be scanned, or the densities of both patterns may be scanned so as to provide the average thereof.

In the present embodiment, each pattern has a marker disposed therein every 32 pixel trains. Also, a marker included in one of two patterns with respect to each color lies between two markers included in the other pattern. With this arrangement, when two patterns are viewed as a single pattern with respect to each color, the single pattern has a marker disposed therein every 16 pixel trains.

When the pattern has no markers inserted therein, there is a risk of unreliably determining that how-manieth a pixel train in question is disposed. For example, when the densities of the pixel trains shown in FIG. 15 are scanned in the order from the leftmost one, there is a risk of occurrence of a greater position error as being farther away from the left end. When the density information does not accurately indicate the position of the corresponding pixel train, density adjustment cannot be accurately performed. Accordingly, the positions of markers are periodically scanned so as to determine how-manieth a pixel train in question lies with respect to the markers.

For example, when the densities of the pixel trains shown in FIG. 15 are scanned in the order from the leftmost end, there are 15 pixel trains on the left side of the first marker (included in the lower one of the two patterns in the figure). Thus, the pixel train lying directly above the first marker and included in the upper pattern is detected as the 16th pixel train.

Since too few markers cause the position of a pixel train in question to be inaccurately detected, and too many markers causes the efficiency of a density-measuring operation to deteriorate, in the present embodiment, one marker is inserted into in the upper and lower patterns every 16 pixel trains.

One of the pixels forming the density-measuring pattern has at least one dot and may have an appropriate number of dots as long as it is acceptable. Although the greater number of dots the better in order to reduce an error caused by fluctuation of an amount of a droplet of each dot, too many dots cause overlaying with the adjacent dots and difficulty in measuring the density of each pixel. In FIG. 15, one pixel is formed by two dots by way of example. Meanwhile, each liquid-discharging unit used in the present embodiment discharges a droplet having a volume of 4.5 pl (pico-litters) at every discharge operation.

By scanning the density of the density-measuring pattern as described above, density information of each of all pixel trains (a value specifying the density of the pixel train) can be obtained. Also, when density information of all pixel trains is given, the average density can be computed. Then, a ratio of the density of each pixel train against the average density or a difference therebetween is computed. Thus, on the basis of the density ratio or difference, the liquid-discharging apparatus is controlled so as to change the number of ink droplets in accordance with a discharge command signal with respect to each pixel train. Such a control of changing the number of ink droplets as described above is independently performed with respect to each color.

For example, when the density of a certain pixel train is lower than the average density, and when the number of ink droplets in accordance with the discharge command signal of the pixel train is N, the number of discharged droplets is set greater than N. Contrary, when the density of a certain pixel train is higher than the average density, and when the number of ink droplets in accordance with the discharge command signal of the pixel train is N, the number of discharged droplets is set smaller than N.

For example, density information is previously stored in a memory of the printer, and, after the printer receives a discharge command signal from an external apparatus such as a computer, the number of discharged ink-droplets is changed on the basis of the stored density information. Alternatively, the density information is previously stored in an external apparatus such as a computer, and the discharge command signal in which the density is adjusted in accordance with the density information (the number of discharged ink-droplets is changed) may be sent to the printer.

Figure 16:
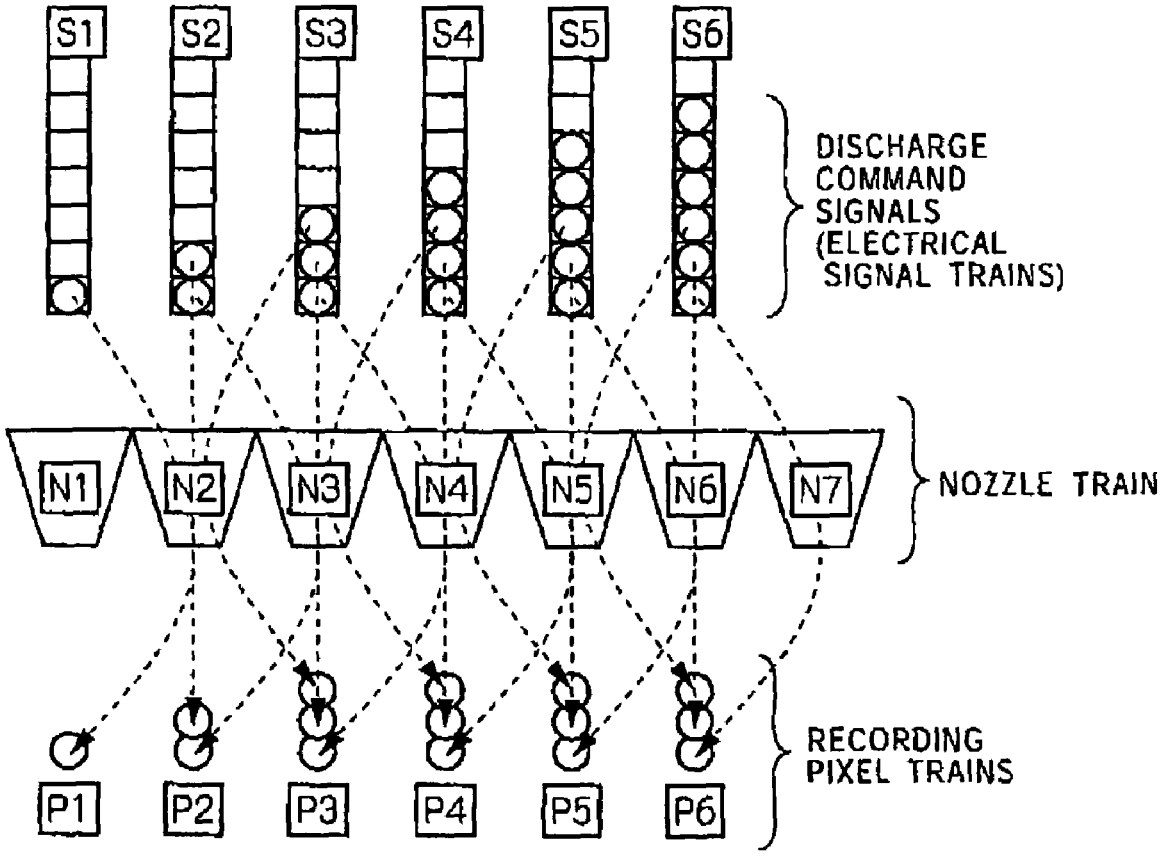
FIG. 16 illustrates the relationship among discharge command signals, liquid-discharging units, and pixel trains.

FIG. 16 illustrates the relationship among discharge command signals (electrical signal trains), liquid-discharging units, and pixel trains.

As shown in FIG. 16, a train of the liquid-discharging units (a train of the nozzles 18) is formed by N1 to N7 liquid-discharging units. Also, discharge command signals are represented by S1 to S6. In addition, pixel trains formed in accordance with these discharge command signals S1 to S6 are represented by P1 to P6.

In the figure, the discharge command signal Sn (n=1 to 6) is a signal for forming n pieces of dots in a pixel area.

More particularly, for example, the pixel train P2 is formed in accordance with the discharge command signal S2 so as to have two pieces of dots.

Also, in FIG. 16, as described above, the discharge command signals are sent to a plurality of neighboring liquid-discharging units, and a single pixel train is formed by these liquid-discharging units. More particularly, as in FIG. 16, the liquid-discharging apparatus is controlled such that, upon receipt of a discharge command signal, ink droplets are discharged from a liquid-discharging unit lying directly above a pixel train to be formed and also from liquid-discharging units lying on both sides of the pixel train. Accordingly, an example shown in FIG. 16 illustrates the second form of the controlling means in the same fashion as that shown in the foregoing FIG. 9.

As shown in FIG. 16, for example, in accordance with the discharge command signal S3, the pixel train P3 is formed so as to have 3 dots. Of the discharge command signal S3, a first part of the discharge command signal is sent to the liquid-discharging unit N4, and the liquid-discharging unit N4 discharges an ink droplet leftward in the figure in a deflecting manner so as to form a dot of the pixel train P3. Also, a second part of the discharge command signal is sent to the liquid-discharging unit N3, and the liquid-discharging unit N3 discharges an ink droplet without deflection so as to form another dot of the pixel train P3. In addition, a third part of the discharge command signal is sent to the liquid-discharging unit N2, and the liquid-discharging unit N2 discharges an ink droplet rightward in the figure in a deflecting manner so as to form another dot of the pixel train P3.

When each train is formed by a plurality of liquid-discharging units discharging ink droplets in a deflecting manner as described above, the pixel train Pn has a characteristic averaged by the discharging characteristics of three liquid-discharging units. Accordingly, the characteristic is possibly corrected even when one of the liquid-discharging units has a discharging problem.

In the present invention, each pixel train is not always formed by a plurality of liquid-discharging units. For example, the head may have a structure in which a single of the heating resistor 13 is disposed in a single of the ink chamber 12 so as to form the pixel train by discharging ink droplets from all nozzles 18 in a direction orthogonal to the plane of a sheet of printing paper.

In this case, when one of the liquid-discharging units has a discharging problem, the density of the pixel train corresponding to the liquid-discharging unit cannot be corrected. Although the density can be corrected to a certain degree by, for example, increasing the numbers of discharged droplets of the liquid-discharging units adjacent to the foregoing liquid-discharging unit, at least the density of the pixel train corresponding to the liquid-discharging unit having a discharging problem is different from those of the other pixel trains, whereby it is difficult to make the difference indistinctive. In contrast to this, when a single discharge command signal is allotted into a plurality of (3 in the example shown in FIG. 16) of liquid-discharging units so as to form a single pixel train by the plurality of liquid-discharging units as in the present embodiment, the above density can be completely corrected.

For example, when a single pixel train is formed by three liquid-discharging units as shown in FIG. 16, and when one of the liquid-discharging units has a discharging problem, the density of the single pixel train is about two third (low density of about 33%). However, for example, when the number of discharged ink-droplets in accordance with the corresponding discharge command signal is magnified by a factor of the 1.75-th power of an inverted value of about two third according to the foregoing expression; N'=N $(An/An')^{1.75}$, that is, is made double, the original density can be restored. For example, when the original number of ink droplets is 3, a pixel train can be formed so as to have a normal density by changing the number to 6, even when one of the liquid-discharging units has a discharging problem.

In the meantime, the number of discharged ink-droplets is in reality must be an integer. Hence, when a computed number of discharged droplets includes fractions below decimal point, the computed number is converted into an integer by round-off processing.

According to the known simple round-off method, since an error generated every computation is omitted, an accumulated error possibly becomes greater.

In view of the above problem, in the present embodiment, a computation error is considered in the subsequent input.

In the present embodiment, upon receipt of a droplet-discharging command signal, on the basis of the density information and the relationship between the number and the density of discharged droplets with respect to the corresponding pixel trains the number of density-adjusted discharged droplets corresponding to the number of droplets discharged in accordance with the discharge command signal is computed, and only a high-order part corresponding to the number of ink droplets to be discharged from the liquid-discharging units is extracted by rounding off the computed result. Thus, the liquid-discharging apparatus is controlled so as to discharge the number of droplets from the liquid-discharging units, corresponding to the extracted higher-order part. In addition, a difference between the foregoing computed result and the extracted higher-order part is computed, and the liquid-discharging apparatus is controlled so as to add the computed difference to the number of ink-droplets discharged in accordance with the subsequent discharge command signal.

Figure 17:
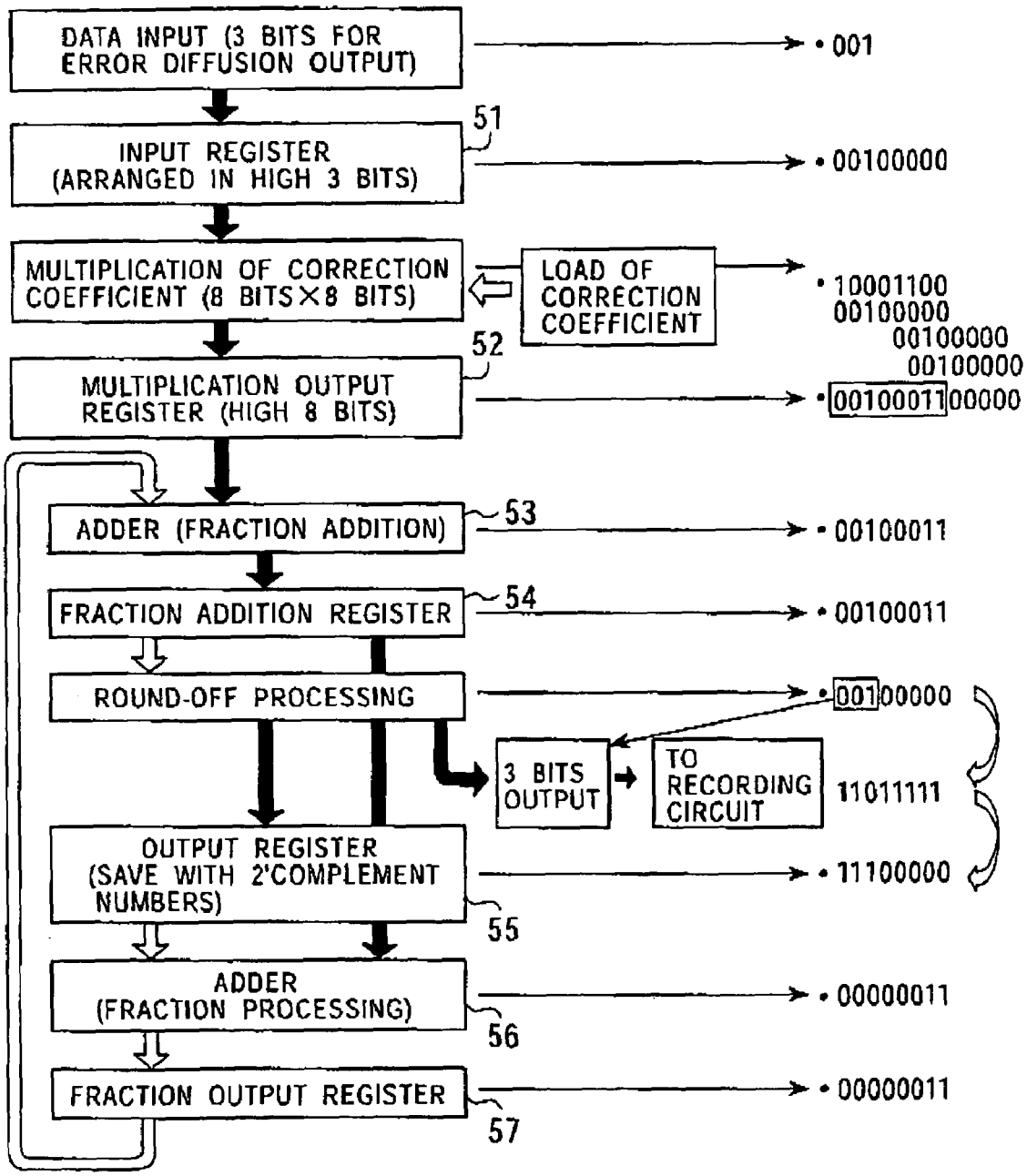
FIG. 17 illustrates example round-off computation according to the present embodiment.

FIG. 17 illustrates an example of round-off computation according to the present embodiment. In this example, an input value is equal to 1, and the number of corrections is 140.

As shown in FIG. 17, when 3-bit data "001" subjected to error diffusion processing is inputted into an input register 51, the data is converted into high a value of 3 bits ("00100000") in 8 bits. Then, a value of 140 ("10001100" in 8 bits) representing the number of corrections is multiplied by the above input value in 8 bits, and a value of high 8 bits "00100011" is outputted from a multiplication output register 52.

The above output value is added to a fraction of a previously computed result (the fraction in the example shown in FIG. 17 is zero) by an adder 53, and the added result is outputted by a fraction addition register 54. The output value "00100011" is subjected to round-off processing. In this example, the fourth bit is rounded off, and the high 3 bits are outputted. That is, a value of the high 3 bits "001" is sent to the line head 10 as an output, Also, the rounded-off result is converted into a two's complement number in order to make signs identical to each other, saved in an output register 55, and is inputted into an adder 56 for being subjected to round-off processing. In the meantime, an output value of the fraction addition register 54 is inputted into the adder 56, and the sum of both values is saved in a fraction output register 57. Since this value is inputted into the adder 53 in the subsequent computation, the computation error is considered.

FIG. 18 is a table illustrating differences in computed results between a round-off method according to the present embodiment (according to a method of considering a computation error in the subsequent input) and a simple round-off method.

In FIG. 18, an external input is obtained by computing the following expression:

$$Y=1.2-\cos\{(\pi/80)X\}\ (X\text{: No. of calculation order shown in the table}).$$

Meanwhile, in the case of the above-described example, when a deviation of the density of a certain pixel train is computed, this external input corresponds to the number of discharged ink-droplets for eliminating the deviation of the density. For example, the first external input of "1.200" means that when the number of discharged ink-droplets is set at 1.2, the deviation of the density is eliminated.

When the external input is equal to "1.200", the number of discharged droplets according to the simple round-off method is set at "1", and a fraction below decimal point "0.2" is omitted.

In the present embodiment, although the number of discharged droplets is set at "1" by rounding-off in the same fashion as described above, a computation error "0.2" occurred this time is added to the subsequent external input.

Accordingly, since the subsequent external input is "1.161", according to the simple round-off method, this value "1.161" is rounded off independently of the previous computed result, and a resultant error "0.161" is omitted again.

In contrast to this, according to the present embodiment, the previous error "0.200" is added to "1.161", and the obtained result "1.361" is rounded off.

With this technique, as shown in FIG. 18 by way of example, outputs according to the simple round-off method are continuously equal to "1" despite of fluctuation of the external input, while outputs according to the error-considered round-off of the present embodiment fluctuate in the range from "0" to "2".

When a fraction is considered in the subsequent external input as described above, computation free of error as a whole can be possible.

Figure 19:
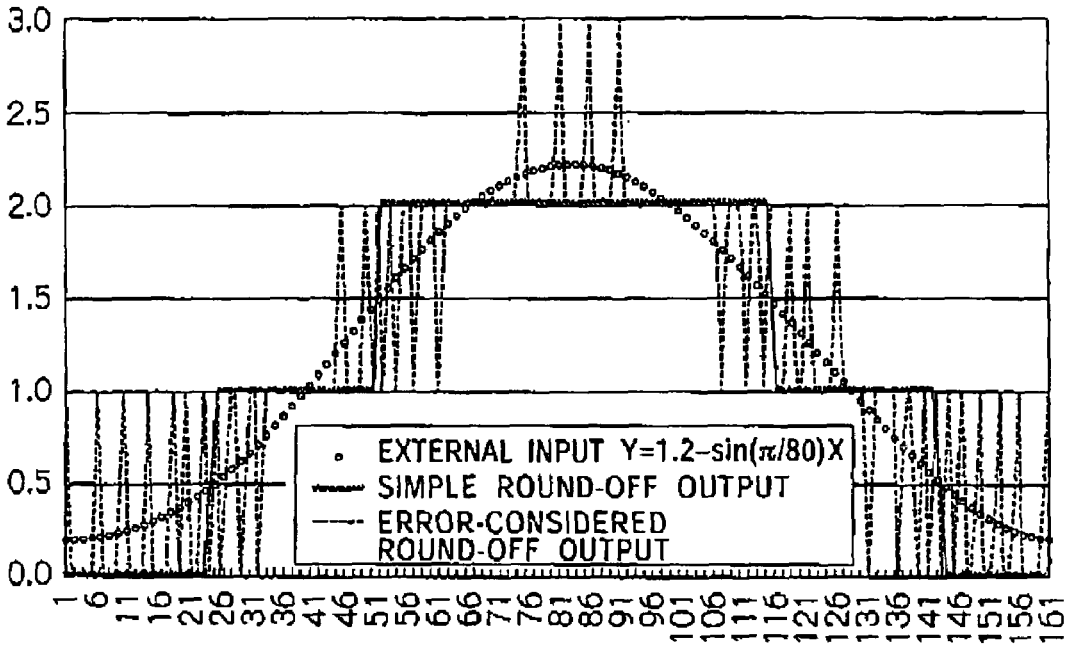
FIG. 19 is a graph of outputs shown in the table in FIG. 18, putting the outputs according to the simple round-off method and those according to the error-considered round-off method according to the present embodiment in contrast with each other.

FIG. 19 is a graph of outputs shown in the table in FIG. 18. In the graph, the outputs according to the simple round-off method and those of the error-considered round-off method according to the present embodiment are put contrast with each other.

As shown in FIG. 19, the outputs according to the simple round-off method show a square form like a rectangular waveform in contrast to a smooth sinusoidal waveform of inputs. That is, since all deviations from the sinusoidal waveform indicate computation errors, as the smoother the form of the input signals becomes, the more the errors become distinguish.

On the contrary, even when values of the outputs according to the round-off method of present embodiment are once determined, in a state in which many errors occur, since the outputs immediately move so as to absorb the errors, the moving average deviations of the outputs vary so as to meet the corresponding inputs while repeatedly varying finely.

Figure 20:
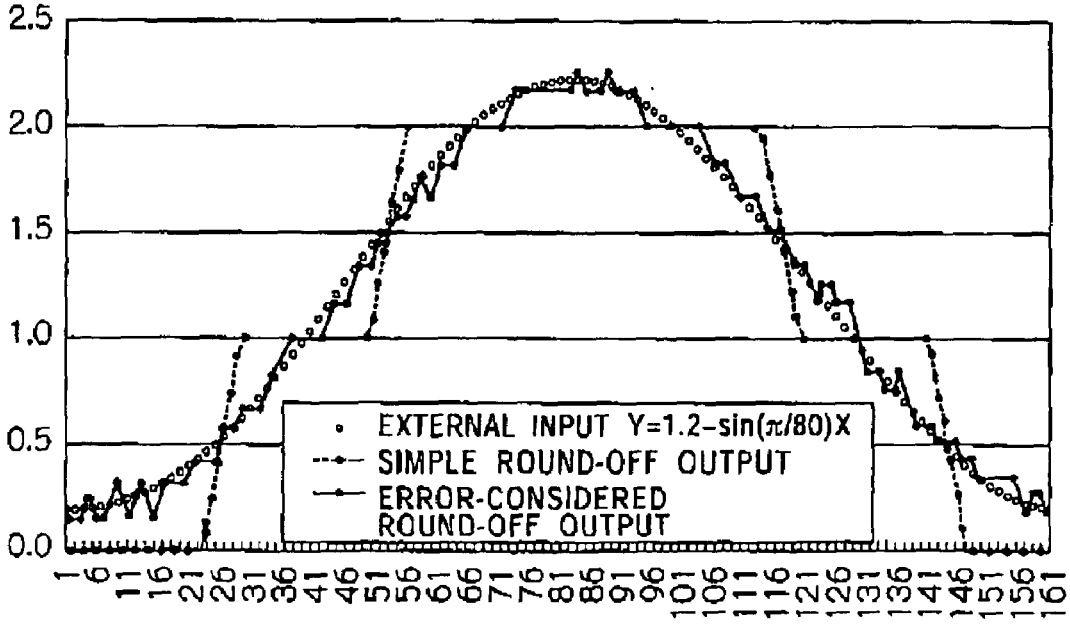
FIG. 20 illustrates an example graph obtained by passing both outputs through an appropriate low-pass filter so as to attenuate high-frequency components of these values.

FIG. 20 illustrates an example graph obtained by passing both outputs through an appropriate low-pass filter so as to attenuate high-frequency components of these values.

Meanwhile, when errors due to rounding off cannot be neglected, bits greater than processing bits normally used in the corresponding system are allotted to the errors so as to ease them or to bring them under control at a practically problem-free level.

Although the errors in FIG. 19 are highly visible since decimals after decimal point are rounded off, if any number of digits after decimal point can be used, even with the simple round-off method, the errors can be made smaller to a problem-free level.

However, there is little room for selecting the number of bits, for example, for the number of discharge commands of a printer. Especially, when an amount of ink droplet during a single discharge operation is fixed as in a thermal printer, it may be taken for granted that only two values (two bits) are allotted. In addition, a higher dot density causes dots to be overlapped with each other or to be fused to each other, thereby resulting in a modulated density. An integral effect provided in a human eye actually leads to the same printed result as that obtained by passing the outputs through a low-pass filter. In such a view, the results shown in FIG. 20 provide an effect of viewing a printed result close to an actual object. Accordingly, with the low-pass filter working effectively, as is seen in FIG. 20, the computed results according to the error-considered round-off method include much fewer errors than those according to the simple round-off method.

Although one embodiment of the present embodiment has been described above, the present invention is not limited to this embodiment, and can be modified in various ways as will be described below, for example.

(1) In the present embodiment, although a difference between the average density and the density of each pixel train is computed, and the density of each pixel train is adjusted in accordance with the difference, a threshold of the difference for determining whether or not performing density adjustment is decided on a voluntary basis. For example, when density adjustment is performed even when there is a small difference between the density of each pixel train and the average density, all pixel trains are provided with a further uniform density although more processing operations are accordingly needed. On the contrary, when density adjustment is performed only with respect to a pixel train having density unevenness to an extent to which a human eye visually determines as an insufficient density, operations of the density adjustment can be made fewer.

(2) In the present embodiment, although the line head 10 is used by way of example, the present invention is not limited to the line head 10 and is applicable to a serial-type printer having a structure in which ink droplets are discharged while moving a head in the main scanning direction and in which a sheet of printing paper is transported in the sub-scanning direction.

The head of the serial-type printer is equivalent to the head 11 as one of those of the line head 10 and is fixed at a position rotated by 90 degrees relative to that of a line-type printer. In the serial-type printer, a direction along which liquid-discharging units are arranged is the sub-scanning direction of the serial-type printer.

With this arrangement, a density-measuring pattern is formed on a sheet of printing paper by providing a droplet-discharging command signal for providing a uniform and constant density to all pixel trains lying in the moving direction of the head (in the main scanning direction of the serial-type printer) and by discharging a predetermined number of ink droplets from each liquid-discharging unit. By scanning the density of the density-measuring pattern, with respect to each pixel train, density information and the relationship between the number and the density of the discharged droplets are obtained.

Then, in the same fashion as in the present embodiment, upon receipt of a droplet-discharging command signal, on the basis of the previously obtained density information of the corresponding pixel train and relationship between the number and the density of discharged droplets with respect to each pixel train, by making the number of droplets to be actually discharged from the liquid-discharging units different from the number of discharged ink-droplets in accordance with the discharge command signal different, the liquid-discharging apparatus is controlled so as to adjust the density of the pixel train corresponding to the discharge command signal.

(3) When the present inventing is applied to a serial-type printer, the head discharging an ink droplet in a reflecting manner as described in the present embodiment may be used, or a head discharging an ink droplet from a nozzle without reflection only in a direction substantially orthogonal to the plane of a sheet of printing paper may be used.

(4) Although droplets are discharged into two directions or three directions by way of example, with the discharge-direction-controlling means according to the present embodiment, droplets may be discharged into any number of directions. In other words, arbitrary number of liquid-discharging units may be used for forming a single pixel train.

(5) In the present embodiment, although times (bubble generation times) of ink droplets on two-way-divided parts of the heating resistors 13 needed for being brought to boiling are made different from each other by feeding different currents to the two-way-divided parts of each heating resistor 13, the present invention is not limited to the above structure. Alternatively, the liquid-discharging apparatus may have a structure in which the two-way-divided parts having a common resistance, of the heating resistor 13 are juxtaposed, and a current is fed to the divided parts at different timings. For example, respectively independent switches are disposed to the divided parts of the heating resistor 13, and when the switches are turned on at respectively different timings, ink droplets on the divided parts of the heating resistor 13 are brought to boiling at different times from each other. In addition, a combination of a method of feeding different currents to the respective parts of the heating resistor 13 and another method of feeding a current to the same at respectively different timings may be possible.

(6) In the present embodiment, although the two-way-divided parts of the heating resistor 13 are juxtaposed in a single of the ink chamber 12 since the way of dividing the heating resistor 13 into two parts is a proved technique from the viewpoint of satisfactory durability, and also, the circuitry of the heating resistors 13 can be made simple, the present invention is not limited to the above structure. Alternatively, three or more divided parts of the heating resistor 13 may be juxtaposed in a single of the ink chamber 12.

(7) In the present embodiment, although the heating resistor 13 is used by way of example, alternatively, a heating element may be used, or an energy-generating element such as an electrostatic discharging-type or piezo-type energy-generating element may be used.

An electrostatic discharging-type energy-generating element is formed by a diaphragm and two electrodes disposed under the diaphragm having an air layer interposed therebetween. When a voltage of a certain value is applied on the two electrodes so as to bend the diaphragm downward, and then, the voltage is changed to zero so as to release an electrostatic force. On this occasion, an ink droplet is discharged by utilizing an elastic force of the diaphragm returning to its original state.

In this case, in order to cause respective energy-generating elements to generate energy in different ways, for example, when the diaphragms of two energy-generating elements are returned to their original states (when the electrostatic force is released by changing the voltage to zero), the two energy-generating elements are arranged so as to generate energy at different timings or to have different voltages applied thereon.

The piezo-type energy-generating element is a laminate formed by a piezo element having electrodes on both surfaces thereof and a diaphragm. When a voltage is applied on the electrodes on both surfaces, the piezoelectric effect of the piezo element causes the diaphragm to produce a bending moment and accordingly to be bent and deformed. An ink droplet is discharged by utilizing this deformation.

Also, in this case, similar to the above case, in order to cause respective energy-generating elements to generate energy in different ways, when a voltage is applied on the electrodes on both surfaces of each piezo element, the voltage is applied on two piezoelectric elements at different timings or mutually different voltages are applied on the two piezoelectric elements.

(8) In the above-described embodiment, the discharge direction of an ink droplet is deflected in the direction along which the nozzles 18 are juxtaposed side by side since the divided parts of the divided nozzle 18 are juxtaposed side by side in the same direction. Meanwhile, the deflecting direction of an ink droplet is not always required to completely agree with the direction along which the nozzles 18 are juxtaposed side by side. Even when a small amount of misalignment remains therebetween, substantially the same effect can be expected as in the case where the deflecting direction of an ink droplet agrees completely with the direction along which the nozzles 18 are juxtaposed side by side.

(9) The round-off processing and the like described in the present embodiment can be achieved not only by a hardware (an operation circuit, or the like) but also by software.

(10) Although the head 11 is used in a printer in the present embodiment by way of example, the head 11 according to the present invention is applicable not only to a printer, but also to a variety of liquid-discharging apparatuses including an apparatus discharging a solution containing DNA for detecting a biological specimen, for example.

As described above, according to the present invention, density unevenness caused by a variation in discharging characteristics of the liquid-discharging units can be adjusted without incurring a reduction in printing speed and the like and also without incurring an increase in hardware, memory, and the like.

What is claimed is:

1. A liquid-discharging method for forming a pixel by landing at least one droplet discharged from one of plurality of liquid-discharging units on a droplet-landing object, and providing gradation in accordance with the number of the landed droplets in a pixel area, comprising the steps of:

providing droplet data for the pixel to be formed;

performing gradation processing including image processing and error diffusion with respect to said droplet data subsequent to said gradation processing providing a corrected droplet-discharging signal to alter a number of ink droplets defining the density of the pixel so that the density of the pixel on the droplet landing object agrees with the droplet data; and controlling the plurality of liquid-discharging units in accordance with the corrected droplet-discharging signal so as to form a pixel on the droplet-landing object in.

2. The liquid-discharging method according to claim 1, wherein for a plurality of pixels defining an image the plurality of liquid-discharging units is controlled such that at least two nearby liquid-discharging units of the plurality of liquid-discharging units discharge droplets in different directions so as to be landed in a single pixel area.

3. A density-adjusting method of a liquid-discharging apparatus comprising a head including a plurality of juxtaposed liquid-discharging units having respective nozzles, forming dots by landing droplets discharged from the nozzles onto a droplet-landing object, and providing half tones by arranging a dot array, comprising the steps of:

obtaining density information, for the discharged droplets of each pixel train by providing a droplet-discharging test command signal for providing a uniform density to all pixel trains lying in a main scanning direction, thereby forming a density-measuring pattern on the droplet-landing object and thereafter scanning the density of the density-measuring pattern;

providing droplet data for pixel train; and controlling the head, upon receipt of a droplet-discharging command signal, on the basis of the previously obtained density information for each pixel train, so as to adjust the density of the pixel train corresponding to the droplet data by altering the number of droplets to be actually discharged from the liquid-discharging units from the number of droplets discharged in accordance with the droplet data.

4. The density adjusting method of a liquid-discharging apparatus according to claim 3, further comprising the step of:

prior to the step of controlling the head performing gradation processing including image processing and error diffusion based upon said droplet data, on the assumption that the density of dot arrays formed by all liquid-discharging units is constant.

5. The density adjusting method of a liquid-discharging apparatus according to claim 3, wherein the liquid-discharging apparatus comprises: discharge-direction-changing means for changing the discharge direction of an ink droplet discharged from the nozzle of each liquid-discharging unit into a plurality of directions within a direction along which the liquid-discharging units are juxtaposed side by side; and discharge-direction-controlling means for controlling at least two nearby liquid-discharging units so as to discharge ink droplets into respectively different directions by using the discharge-direction-controlling means and to land the discharged droplets on a single pixel train so as to form a pixel train or in a single pixel area so as to form a pixel.

6. The density adjusting method of a liquid-discharging apparatus according to claim 3, further comprising the steps of:

computing the number of droplets to be discharged corresponding to the number of droplets discharged in accordance with the discharge command signal;

extracting only a high-order part corresponding to the number of ink droplets to be discharged from the liquid-discharging units by rounding off the computed result;

controlling the liquid-discharging apparatus so as to discharge the number of droplets from the liquid-discharging units, corresponding to the extracted higher-order part:

computing a difference between the computed result and the extracted higher-order part: and controlling the liquid-discharging apparatus so as to add the computed difference to the number of discharged ink-droplets in accordance with a subsequent discharge command signal.

7. The density adjusting method of a liquid-discharging apparatus according to claim 3, wherein the liquid-discharging apparatus comprises an image-scanning apparatus, the density adjusting method further comprising the step of scanning the density of the density-measuring pattern formed on the droplet-landing object by the image-scanning apparatus.

8. A density-adjusting system of a liquid-discharging apparatus, comprising a head including a plurality of juxtaposed liquid-discharging units, forming a pixel by landing at least one droplet discharged from one of the plurality of liquid-discharging units onto a droplet-landing-object, and providing gradation in accordance with the numnber of the landed droplets, comprising:

an image-scanning apparatus scanning the density of the pixel formed by the liquid-discharging unit; a density-measuring-pattern-forming unit causing the liquid-discharging apparatus to form a density-measuring pattern on the droplet-landing object in accordance with a droplet-discharging signal defining the density of the pixel in accordance with the number of droplets forming the pixel; a scanning unit causing the image-scanning apparatus to scan the density of the density-measuring pattern formed by the density-measuring-pattern-forming unit; and a control unit controlling the plurality of liquid-discharging units in accordance wity the corrected droplet-discharging signal corrected such that on the basis of the scanned result of the density-measuring pattern scanned by the scanning unit, the droplet-discharging signal is corrected and the number of droplets forming the pixel is modified so as to make the density of the pixel on the droplet-landing object agree with the density in accordance with the original droplet-discharging signal; and wherein the droplet-discharging signal is corrected after gradation processing including image processing and error diffusion is performed.

9. A density-adjusting system of a liquid-discharging apparatus from claim 8, comprising a head including a plurality of juxtaposed liquid-discharging units, forming a pixel by landing at least one droplet discharged from one of the plurality of liquid-discharging units onto a droplet-landing-object, and providing gradation in accordance with the number of the landed droplets, comprising;

an image-scanning apparatus scanning the density of the pixel formed by the liquid-discharging unit; a density-measuring-pattern-forming unit causing the liquid-discharging apparatus to form a density-measuring pattern on the droplet-landing object in accordance with a droplet-discharging signal defining the density of the pixel in accordance with the number of droplet forming the pixel; a scanning unit causing the image-scanning apparatus to scan the density of the density-measuring pattern formed by the density-measuring-pattern-forming unit: and a control unit controlling the plurality of liquid-discharging units in accordance with the corrected droplet-discharging signal corrected such that, on the basis of hte scanned result of the density-measuring pattern scanned by the scanning unit the droplet-discharging signal is corrected and the number of droplets forming the pixel is modified so as to make the density of the pixel on the droplet-landing object agree with the density in accordance with the original droplet-discharging signal; and wherein the plurality of liquid-discharging units is controlled so as to form a pixel such that at least two nearby liquid-discharging units of the plurality of liquid-discharging units discharge droplets in different directions so as to be landed in a single pixel area.

10. A density-adjusting system of a liquid-discharging apparatus comprising a head including a plurality of juxtaposed liquid-discharging units having respective nozzles, forming dots by landing droplets discharged from the nozzles onto a droplet-landing object, and providing half tones by arranging a dot array, comprising:

an image-scanning apparatus scanning the density of the dot array formed by the image-discharging apparatus;

a density-measuring-pattern-forming unit causing the liquid-discharging apparatus to discharge a predetermined number of droplets from each of the liquid-discharging units so as to form a density-measuring pattern on the droplet-landing object in accordance with a density measuring pattern discharge command signal providing a uniform density to all, pixel trains lying in a main scanning direction;

a scanning unit causing the image-scanning apparatus to scan the density of the density-measuring pattern formed by the density-measuring-pattern-forming unit;

an obtaining unit obtaining density information with respect to each pixel train on the basis of the scanned result of the density-measuring pattern scanned by the scanning unit:

a memory storing the density information, obtained by the obtaining unit; and a control unit controlling the head upon receipt of a droplet-discharging command signal, on the basis of imput image information and the density information stored in the memory with respect to each pixel train, so as to adjust the density of the pixel train corresponding to the input image information by making the number of droplets to be actually discharged from the liquid-discharging units different from the number of droplets in accordance with the input image information.

11. The density-adjusting system of a liquiddischarging apparatus according to claim 10, wherein the control unit controls the liquid-discharging apparatus so as to adjust the density of a pixel train corresponding to input image information is converted after gradation processing including image processing and error diffusion is performed upon receipt of input image information and on the assumption that the density of dot arrays formed by all liquid-discharging units is constant, by discharging a number of ink droplets from the liquid-discharging units different from the number of droplets in accordance with the input image information.

12. The density-adjusting system of a liquid-discharging apparatus according to claim 10, wherein the liquid-discharging apparatus comprises discharge-direction-changing means for changing the discharge direction of an ink droplet discharged from the nozzle of each liquid-discharging unit into a plurality of directions within a direction along which the liquid-discharging units are juxtaposed side by side: and discharge-direction-controlling means controlling at least two nearby liquid-discharging units so as to discharge ink droplets into respectively different directions by using the discharge-direction-controlling means and to land the discharged droplets on a single pixel train so as to form a pixel train or in a single pixel area so as to form a pixel.

13. The density-adjusting system of a liquid-discharging apparatus according to claim 10, wherein the control unit comprises: a first computing unit, which upon receipt of a droplet-discharging command signal, computes the number of density-adjusted discharged droplets corresponding to the number of droplets to be discharged in accordance with the discharge command signal on the basis of the density information stored in the memory; an extracting unit extracting only a high-order part corresponding to the number of ink droplets to be discharged from the liquid-discharging units by rounding off the computed result; and wherein, the liquid-discharging apparatus is controlled so as to discharge the number of droplets from the liquid-discharging units, corresponding to the extracted higher-order part; a discharge-instructing unit instructing the liquid-discharging units to discharge the number of droplets corresponding to the high-order part extracted by the extracting unit; a second computing unit computing a difference between the computed result of the first computing unit and the high-order part extracted by the extracting unit; and an adding unit adding the difference computed by the second computing unit to the number of droplets discharged in accordance with a subsequent discharge command signal.

14. The density-adjusting system of a liquid-discharging apparatus according to claim 10, wherein the image-discharging apparatus comprises the image-scanning unit.

15. A liquid-discharging apparatus comprising: a plurality of liquid-discharging units for forming a pixel by landing at least one droplet discharged by one of the plurality of liquid-discharging units onto a droplet-landing object, and providing gradation in accordance with the number of droplets landed in a pixel area, wherein a droplet-discharging signal defining the density of the pixel in accordance with the number of droplets is corrected and the number of droplets forming the pixel is modified so that the density of the pixel on the droplet-landing object agrees with the density in accordance with the droplet-discharging signal, and the plurality of liquid-discharging units is controlled in accordance with the corrected droplet-discharging signal so as to form a pixel on the droplet-landing object in accordance with the modified number of droplets.

16. The liquid-discharging apparatus according to claim 15, wherein the droplet-discharging signal is corrected after gradation processing including image processing and error diffusion is performed.

17. The liquid-discharging apparatus according to claim 15, wherein the plurality of liquid-discharging units is controlled so as to form a pixel such that at least two nearby liquid-discharging units of the plurality of liquid-discharging units discharge droplets in different directions so as to be landed in a single pixel area.

18. A liquid-discharging apparatus comprising a head including a plurality of juxtaposed liquid-discharging units having respective nozzles, forming dots by landing droplets discharged from the nozzles onto a droplet-landing object, and providing half tones by arranging a dot array, comprising:

a density-measuring-pattern-forming unit forming a density-measuring pattern on the droplet-landing object in accordance with a discharge command signal providing a uniform density to all pixel trains lying in the main scanning direction by causing each of the liquid-discharging units to discharge a predetermined number of droplets;

a memory storing density information with respect to each pixel train obtained by scanning the density of the density-measuring pattern formed by the density-measuring-pattern-forming unit; and a control unit controlling the head, upon receipt of a droplet-discharging command signal, on the basis of input image information and the stored in the memory with respect to each pixel train, so as to adjust the density of the pixel train corresponding to the discharge command signal by making the number of droplets to be actually discharged from the liquid-discharging units different from the number of droplets discharged in accordance with the input image information.

19. The liquid-discharging apparatus according to claim 18, further comprising:

discharge-direction-changing means changing the discharge direction of an ink droplet discharged from the nozzle of each liquid-discharging unit into a plurality of directions within a direction along which the liquid-discharging units are juxtaposed side by side; and discharge-direction-controlling means controlling at least two nearby liquid-discharging units so as to discharge ink droplets into respectively different directions by using the discharge-direction-controlling means and to land the discharged droplets on a single pixel train so as to form a pixel train or in a single pixel area so as to form a pixel.

20. The liquid-discharging apparatus according to claim 18, wherein the control unit comprises; a first computing unit which upon receipt of a droplet-discharging command signal computes the number of density-adjusted discharged droplets corresponding to the number of droplets discharged in accordance with the discharge command signal on the basis of the density information stored in the memory; an extracting unit extracting only a high-order part corresponding to the number of ink droplets to be discharged from the liquid-discharging units by rounding off the computed result and wherein the liquid-discharging apparatus is controlled so as to discharge the number of droplets from the liquid-discharging units, corresponding to the extracted higher-order part; a discharge-instructing unit instructing the liquid-discharging units to discharge the number of droplets corresponding to the high-order part extracted by the extracted by the extracting unit; a second computing unit computing a difference between the computed result of the first computing unit and the high-order part extracted by the extracting unit; and an adding unit adding the difference computed by the second computing unit to the number of droplets discharged in accordance with a subsequent discharge command signal.

21. The liquid-discharging apparatus according to claim 18, further comprising a scanning unit scanning the density of the density-measuring pattern formed by the density-measuring-pattern-forming unit.

* * * * *